US009217985B2

(12) United States Patent
Komito et al.

(10) Patent No.: US 9,217,985 B2
(45) Date of Patent: Dec. 22, 2015

(54) IMAGE BEARING MEMBER PROTECTING AGENT, PROTECTIVE LAYER FORMING DEVICE, AND IMAGE FORMING APPARATUS

(71) Applicants: Kenji Komito, Kanagawa (JP); Hiroshi Nakai, Kanagawa (JP); Kunio Hasegawa, Kanagawa (JP); Takuya Sekine, Kanagawa (JP)

(72) Inventors: Kenji Komito, Kanagawa (JP); Hiroshi Nakai, Kanagawa (JP); Kunio Hasegawa, Kanagawa (JP); Takuya Sekine, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/039,379

(22) Filed: Sep. 27, 2013

(65) Prior Publication Data

US 2014/0093294 A1 Apr. 3, 2014

(30) Foreign Application Priority Data

Oct. 3, 2012 (JP) ..... 2012-221226

(51) Int. Cl.
*G03G 21/00* (2006.01)

(52) U.S. Cl.
CPC ..... *G03G 21/0094* (2013.01)

(58) Field of Classification Search
USPC ..... 399/346
See application file for complete search history.

(56) References Cited

U.S. PATENT DOCUMENTS

| | | | | |
|---|---|---|---|---|
| 3,501,294 | A | 3/1970 | Joseph | |
| 2006/0285897 | A1 | 12/2006 | Sugiura et al. | |
| 2007/0054122 | A1* | 3/2007 | Paisner et al. | 428/403 |
| 2007/0123435 | A1 | 5/2007 | Usami | |
| 2008/0076856 | A1* | 3/2008 | Zhong et al. | 524/81 |
| 2009/0085259 | A1* | 4/2009 | Nishi et al. | 264/469 |
| 2009/0196665 | A1 | 8/2009 | Tanaka et al. | |
| 2009/0285613 | A1 | 11/2009 | Nakai et al. | |
| 2009/0290919 | A1 | 11/2009 | Tanaka et al. | |
| 2009/0311014 | A1 | 12/2009 | Tanaka et al. | |
| 2010/0034560 | A1 | 2/2010 | Tanaka et al. | |
| 2010/0034570 | A1* | 2/2010 | Hatakeyama et al. | 399/346 |
| 2010/0054829 | A1 | 3/2010 | Iio et al. | |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2012/0021358 | A1* | 1/2012 | Taguchi et al. | 430/302 |
| 2012/0060753 | A1 | 3/2012 | Tanaka et al. | |
| 2012/0063809 | A1 | 3/2012 | Tanaka et al. | |
| 2012/0101011 | A1* | 4/2012 | Makino et al. | 508/100 |

(Continued)

FOREIGN PATENT DOCUMENTS

| | | |
|---|---|---|
| JP | 51-022380 | 7/1976 |
| JP | 2006-350240 | 12/2006 |
| JP | 2007-145993 | 6/2007 |

(Continued)

*Primary Examiner* — David Gray
*Assistant Examiner* — Geoffrey Evans
(74) *Attorney, Agent, or Firm* — Harness, Dickey & Pierce

(57) ABSTRACT

Provided is an image bearing member protecting agent which contains a fatty acid metal salt and an inorganic lubricant, wherein an aspect ratio (average major axis length/average minor axis length) of the inorganic lubricant is 60 to 400, and a mass ratio of the fatty acid metal salt to the inorganic lubricant (fatty acid metal salt/inorganic lubricant) is 98/2 to 85/15.

9 Claims, 3 Drawing Sheets

(56) References Cited

U.S. PATENT DOCUMENTS

2014/0363212 A1* 12/2014 Zona et al. ..... 399/346
2015/0090922 A1* 4/2015 Hatakeyama et al. ..... 252/74

FOREIGN PATENT DOCUMENTS

JP 2009-282160 12/2009
JP 2009-300861 12/2009

* cited by examiner

IMAGE BEARING MEMBER PROTECTING AGENT, PROTECTIVE LAYER FORMING DEVICE, AND IMAGE FORMING APPARATUS

BACKGROUND OF THE INVENTION

1. Field of the Invention

The present invention relates to an image bearing member protecting agent, a protective layer forming device, and an image forming apparatus.

2. Description of the Related Art

Conventionally, in electrophotographic image formation, a latent electrostatic image is formed on an image bearing member containing a photoconductive material, and charged toner particles are attached to the latent electrostatic image to thereby form a visible image. The visible image formed with the toner particles is finally transferred onto a recording medium such as paper, and then fixed on the recording medium under application of heat, pressure, a solvent, or gas to thereby form an output image.

Such electrophotographic image forming methods are broadly classified, depending on a method for charging toner particles to form a visible image, into so-called two-component developing methods in which toner particles and carrier particles are stirred and mixed so as to be frictionally charged; and so-called one-component developing methods in which toner particles are charged without using carrier particles.

Further, the one-component developing methods are classified into magnetic one-component developing methods and nonmagnetic one-component developing methods, depending on whether a magnetic force is used to keep toner particles held to a surface of a developing roller.

In copiers and complex machines based upon the copiers for which high-speed processing capability and image reproducibility are required, the two-component developing methods have been employed in many cases due to demands for stable chargeability of toner particles, stable charge rising properties of the toner particles, and long-term stability of image quality; whereas in compact printers and facsimiles for which space saving and cost reduction are required, the one-component developing methods have been employed in many cases.

Also, nowadays in particular, the technology of colorization of output images is progressing, and demands for improvement of image quality and stabilization of image quality are increasing like never before. For the improvement of image quality, toner particles have been made smaller in average particle diameter, and have been made rounder in shape with their angular parts removed.

Generally, in an image forming apparatus which operates in accordance with any such electrophotographic image forming method, regardless of which developing method is employed, a drum-shaped or belt-shaped image bearing member is uniformly charged while being rotated, a latent image pattern is formed on the image bearing member by, for example, laser light, and the latent image pattern is visualized as a toner image by a developing unit and transferred onto a recording medium. After the toner image has been transferred onto the recording medium, untransferred toner remains on the image bearing member. If such residual toner is directly conveyed to a region for the charging step, it may hinder the image bearing member from being uniformly charged. Accordingly, in general, the residual toner remaining on the image bearing member after the transfer step is removed at a cleaning step to thereby sufficiently clean the surface of the image bearing member, and then the charging is carried out.

Thus, various types of physical stress and electrical stress in each step in the image formation (e.g., a charging step, a developing step, a transfer step and a cleaning step) are applied onto the surface of the image bearing member, which changes a state thereof over a period of time. Of those stresses, frictional stress generated at the cleaning step causes abrasion of the image bearing member and scratches on its surface.

To solve this problem, that is, to reduce the friction between the image bearing member and a cleaning blade, there have been various proposals for image bearing member protecting agents and methods of supplying lubricant components and forming films (for example, see Japanese Patent Application Publication (JP-B) No. 51-22380, and Japanese Patent Application Laid-Open (JP-A) Nos. 2006-350240 and 2007-145993).

Recently, the present applicant has been proposed an image bearing member protecting agent which contains zinc stearate serving as a fatty acid metal salt and boron nitride serving as an inorganic lubricant for the purposes of preventing abrasion of an image bearing member, toner filming on the image bearing member, smear of a charging unit, and passing-through of toner (see JP-A Nos. 2009-282160 and 2009-300861).

In the above proposals, relatively large amount (i.e., 20% by mass) of boron nitride is incorporated. In this case, boron nitride having an aspect ratio of 15 to 35 (see Examples 3 to 5 in JP-A No. 2009-282160 and Examples 3 to 5 in JP-A No. 2009-300861) produces a satisfactory result such as excellent photoconductor-protecting property and less smear of a charging unit. However, it has been recognized that boron nitride having the aspect ratio of 50 or more reduces photoconductor-protecting property (see Comparative Examples 5 and 6 in JP-A No. 2009-282160 and Comparative Examples 6 to 11 in JP-A No. 2009-300861). Additionally, boron nitride is more expensive than zinc stearate (a price difference therebetween is 20 times or more), so that there has been a need for achieving good properties while the content of boron nitride serving as the inorganic lubricant is kept low.

Therefore, there is still room for consideration with respect to optimization of the aspect ratio of the inorganic lubricant, and adjustment of a mass ratio of the fatty acid metal salt to the inorganic lubricant (fatty acid metal salt/inorganic lubricant). Further, there has been a need for preventing abrasion of an image bearing member, toner filming on the image bearing member, smear of a charging unit, and passing-through of toner at a cleaning step while the content of the inorganic lubricant (in particular, boron nitride) is kept low.

SUMMARY OF THE INVENTION

An object of the present invention is to provide an image bearing member protecting agent being capable of preventing abrasion of an image bearing member, toner filming on the image bearing member, smear of a charging unit, and passing-through of toner at a cleaning step while the content of the inorganic lubricant is kept low.

A means for solving the above problems is the image bearing member protecting agent of the present invention which contains a fatty acid metal salt and an inorganic lubricant, wherein an aspect ratio (average major axis length/average minor axis length) of the inorganic lubricant is 60 to 400, and a mass ratio of the fatty acid metal salt to the inorganic lubricant (fatty acid metal salt/inorganic lubricant) is 98/2 to 85/15.

The present invention can solve the above existing problems, and provide an image bearing member protecting agent being capable of preventing abrasion of an image bearing member, toner filming on the image bearing member, smear of a charging unit, and passing-through of toner at a cleaning step while the content of the inorganic lubricant is kept low.

Figure 1:
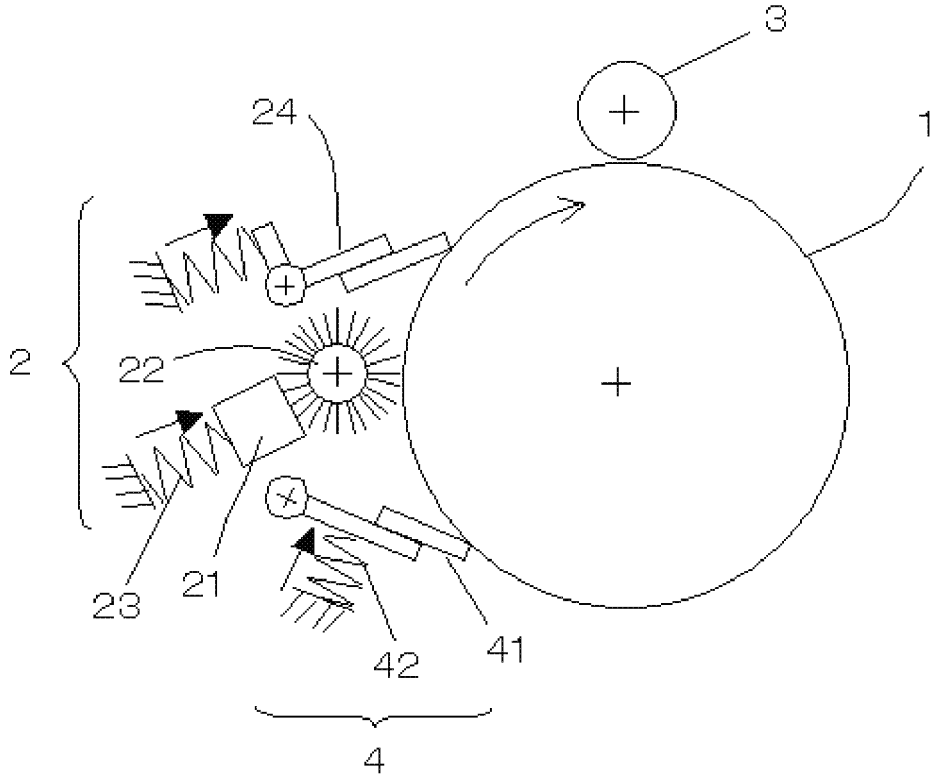
FIG. 1 is a schematic diagram showing one exemplary protective layer forming device of the present invention.

DETAILED DESCRIPTION OF THE INVENTION (Image Bearing Member Protecting Agent)

An image bearing member protecting agent of the present invention contains a fatty acid metal salt and an inorganic lubricant; and, if necessary, further contains other ingredients.

<Inorganic Lubricant>

The inorganic lubricant, as used herein, means a compound which exhibits lubricating properties by being cleaved or which induces internal lubricating action.

The inorganic lubricant is not particularly limited and may be appropriately selected depending on the intended purpose. Examples thereof include mica, boron nitride, molybdenum disulfide, tungsten disulfide, talc, kaolin, montmorillonite, calcium fluoride and graphite. These may be used alone or in combination. Among them, boron nitride is preferable because it is a substance in which hexagonal network planes formed by firmly bonded atoms are laminated on top of one another with sufficient space therebetween, and the planes are bonded by only a weak van der Waals force; therefore, the planes are easily cleaved to thereby exhibit lubricating properties.

An aspect ratio (average major axis length/average minor axis length) of the inorganic lubricant is 60 to 400, preferably 80 to 350, more preferably 100 to 300. When the aspect ratio is less than 60, a film forming property is deteriorated and a charging member is smeared to thereby deteriorate cleanability. When the aspect ratio is more than 400, the inorganic lubricant tends to accumulate on a photoconductor, potentially leading to low protectivity of the photoconductor.

When the aspect ratio falls within the preferable range, it is advantageous in improving the film forming property, eliminating the smear of a charging unit, and improving cleanability and photoconductor-protecting property.

The aspect ratio (average major axis length/average minor axis length) is measured by, for example, observing the inorganic lubricant under a scanning electron microscope (SEM) (Thermal F-SEM, product of Carl Zeiss AG, ULTRA 55), followed by analyzing using an image analysis and measurement software (IMAGE-PRO PLUS 4.0j, product of Roper Industries, Inc.). An average value of major axis lengths of primary particles of the inorganic lubricant is determined as an average particle diameter x, an average value of minor axis lengths of primary particles of the inorganic lubricant is determined as an average thickness t, and a ratio of x to t (x/t) is determined as an aspect ratio. Notably, randomly selected 10 particles were used for determining the aspect ratio.

An inorganic lubricant having the aspect ratio (average major axis length/average minor axis length) of 60 to 400 is not particularly limited and may be commercial products. Examples of the commercial products include boron nitride (product of Mizushima Ferroalloy Co., Ltd., HP-P1, aspect ratio: 100), boron nitride (product of FNAMI Technology corp., FNAMI 050, aspect ratio: 119), boron nitride (profuct of FNAMI Technology corp., FNAMI 010, aspect ratio: 179), boron nitride (product of Saint-Gobain K.K., IDL 700, aspect ratio: 269), boron nitride (product of DENKI KAGAKU KOGYO KABUSHIKI KAISHA, GP, aspect ratio: 381), boron nitride (product of DENKI KAGAKU KOGYO KABUSHIKI KAISHA, HGP, aspect ratio: 250), and mica (product of YAMAGUCHI MICA CO., LTD., Y-1800, aspect ratio: 170), any of which may be suitably used in the present invention.

Examples of commercial products of the inorganic lubricant having the aspect ratio (average major axis length/average minor axis length) of less than 60 include boron nitride (product of NanoGram Corporation, aspect ratio: 3.5), boron nitride (product of Mizushima Ferroalloy Co., Ltd., FS-1, aspect ratio: 25), boron nitride (product of Momentive Performance Materials Inc., NX5, aspect ratio: 15), boron nitride (product of Momentive Performance Materials Inc., NX9, aspect ratio: 15), boron nitride (product of Momentive Performance Materials Inc., NX10, aspect ratio: 15), boron nitride (product of DENKI KAGAKU KOGYO KABUSHIKI KAISHA, SP-2, aspect ratio: 35), and boron nitride (profuct of ESK CERAMICS GMBH & CO. KG, S1-F, aspect ratio: 50), any of which cannot be used in the present invention due to low aspect ratio.

Examples of commercial products of the inorganic lubricant having the aspect ratio (average major axis length/average minor axis length) of more than 400 include boron nitride (product of Saint-Gobain K.K., IDL 800, aspect ratio: 448), boron nitride (product of DENKI KAGAKU KOGYO KABUSHIKI KAISHA, MGP, aspect ratio: 650), boron nitride (profuct of ESK CERAMICS GMBH & CO. KG, S-15, aspect ratio: 750), boron nitride (product of DENKI KAGAKU KOGYO KABUSHIKI KAISHA, SGP, aspect ratio: 885), and mica (product of YAMAGUCHI MICA CO., LTD., TM-200, aspect ratio: 420), any of which cannot be used in the present invention due to high aspect ratio.

<Fatty Acid Metal Salt>

The fatty acid metal salt is not particularly limited and may be appropriately selected depending on the intended purpose. Examples of the fatty acid metal salt include barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, zinc laurate, cobalt laurate, lead laurate, and magnesium laurate. These may be used alone or in combination. Among them, particularly preferable is zinc stearate from the viewpoints of excellent cleanability and photoconductor-protecting property, low-cost, excellent hydrophobicity, and high stability.

A mass ratio of the fatty acid metal salt to the inorganic lubricant (fatty acid metal salt/inorganic lubricant) is 98/2 to 85/15, more preferably 95/5 to 90/10. The fatty acid metal salt which exceeds the above range of the mass ratio (fatty acid metal salt/inorganic lubricant) may lead to a decreased amount of film to be formed, smear of a charging unit, and deterioration of cleanability. Meanwhile, the inorganic lubricant which exceeds the above range of the mass ratio (fatty acid metal salt/inorganic lubricant) may lead to deterioration of photoconductor-protecting property.

When the mass ratio (fatty acid metal salt/inorganic lubricant) falls within the above preferable range, it is advantageous in improving the film forming property, eliminating the smear of a charging unit, and improving cleanability and photoconductor-protecting property while the content of boron nitride, which is expensive, is kept low.

<Other Ingredients>

The other ingredients are not particularly limited and may be appropriately selected depending on the intended purpose. Examples thereof include inorganic particles such as silica, alumina, ceria, zirconia, clay, and calcium carbonate, or surface-hydrophobized particles thereof; organic particles such as polymethyl methacrylate particles, polystyrene particles, silicone resin particles, and α-olefin-norbornene-copolymer resin particles; and a surfactant.

The image baring member protecting agent of the present invention can be molded into a specific shape, such as prismatic shape and columnar shape using known methods for molding solid material. Examples thereof include a melt molding method, a powder molding method, a heat-press molding method a cold isotropic pressure (CIP) method and a hot isostatic press method.

In the melt molding method, a molded article can be as follows. A predetermined amount of a heat-melted fatty acid metal salt is poured into a predetermined shaped mold which has been heated to a temperature equal to or higher than the melting temperature of the image bearing member protecting agent, followed by optionally keeping at a temperature equal to or higher than the melting point for a certain period of time, and naturally or slowly cooling. In order to remove internal strain of the molded article, after reaching a temperature lower than the phase transition temperature of the fatty acid metal salt during the cooling step, the molded article may further be slowly reheated to a temperature equal to or higher than the phase transition temperature.

The molded article is then cooled to a temperature near a room temperature and removed from the mold to thereby obtain the molded article of the image bearing member protecting agent. Thereafter, the shape of the image bearing member protecting agent may be adjusted through a cutting process.

The mold is preferably made of metals such as steel, stainless or aluminum from the viewpoints of excellent thermal conductivity and dimensional accuracy. An inner wall surface of the mold is preferably coated with a releasing agent such as fluorine resins or silicone resins so as to improve releasability.

Notably, thus produced block-shaped image bearing member protecting agent is adhered to a base such as metal, alloy or plastic using an adhesive.

The image bearing member protecting agent of the present invention is capable of preventing abrasion of an image bearing member, toner filming on the image bearing member, smear of a charging unit, and passing-through of toner at a cleaning step while the content of the inorganic lubricant (in particular, expensive boron nitride) is kept low. Accordingly, the image bearing member protecting agent of the present invention can be suitably used for the following protective layer forming device.

(Protective layer Forming Device)

A protective layer forming device of the present invention includes the image bearing member protecting agent of the present invention, and an image bearing member protecting agent supplying member; preferably includes a protective layer forming member; and, if necessary, further includes other members such as a pressing force applying member.

The image bearing member protecting agent supplying member is a member configured to supply the image bearing member protecting agent of the present invention to a surface of the image bearing member.

The protective layer forming member is a member configured to press the image bearing member protecting agent of the present invention which has been supplied to the surface of the image bearing member against the surface of the image bearing member to thereby form a protective layer on the surface of the image bearing member.

The pressing force applying member is a member configured to press the image bearing member protecting agent of the present invention against the image bearing member protecting agent supplying member.

In the case where the protective layer forming device includes the protective layer forming member, the protective layer forming member can also function as a cleaning unit. However, in order to ensure formation of the protective layer, it is preferably that a separate cleaning unit previously removes a residue which mainly contains a toner remaining on the image bearing member so as to prevent the protective layer from being contaminated with the residue.

FIG. 1 is a schematic diagram showing one exemplary protective layer forming device of the present invention.

A protective layer forming device 2 which is disposed so as to face a photoconductor drum serving as an image bearing member 1, includes an image bearing member protecting agent 21 of the present invention, a protecting agent supplying member 22, a pressing force applying member 23, and a protective layer forming member 24.

The image bearing member protecting agent 21 of the present invention is pressed with the pressing force applying member 23 so as to bring into contact with the brush-shaped protecting agent supplying member 22. The protecting agent supplying member 22 rotates and slides at a linear velocity different from that of the image bearing member 1, during which the protecting agent supplying member 22 supplies the image bearing member protecting agent 21 which is held on the surface thereof to the surface of the image bearing member 1.

The image bearing member protecting agent 21 which has supplied to the surface of the image bearing member 1 may not form a satisfactory protective layer depending on types of materials used. Thus, in order to form a more uniform protective layer, the protective layer forming member 24 having a blade-shaped member can be used for thinning the image bearing member protecting agent and thereby forming into the protective layer.

The image bearing member 1 on which the protective layer has been formed is charged by, for example, coming into contact with or approaching a charging roller 3 to which direct current or direct current superimposed with alternate current has been applied from a high-voltage power source (not shown) to thereby cause discharge at a microgap therebetween. During charging, a part of the protective layer is decomposed or oxidized by electrical stress. Further, air discharge products are adhered to the surface of the protective layer.

The deteriorated image bearing member protecting agent is removed, by a conventional cleaning unit, along with other ingredients such as a toner remaining on the image bearing member 1. The cleaning unit can also function as the protective layer forming member 24. However, a sliding condition suitable for removing a residue remaining on the surface of the image bearing member may be different from that of for forming the protective layer. Thus, a separate cleaning unit 4 including a cleaning member 41 and a pressing mechanism for cleaning 42 is preferably provided at an upstream of an image bearing member protecting agent supplying portion as shown in FIG. 1.

Materials of the blade used for the protective layer forming member 24 are not particularly limited and may be appropriately selected depending on the intended purpose. Examples thereof include urethane rubber, hydrin rubber, silicone rubber and fluororubber. These may be used alone or in combination. A contact portion between the above-listed rubber blade and the image bearing member can be coated or impregnated with materials having a low-frictional coefficient. Further, a filler such as an organic filler and an inorganic filler can be dispersed in an elastic body so as to adjust its elasticity.

The blade is secured to a blade support using arbitrarily selected methods such as adhesive bonding or fusion bonding so that the tip of the blade is pressed against and in contact with the surface of the image bearing member. The thickness of the blade is not particularly limited and cannot be unequivocally defined because it varies depending upon a balance with an applied pressing force, but is preferably 0.5 mm to 5 mm, more preferably 1 mm to 3 mm.

The free length of the cleaning blade, i.e., the length of a portion of the cleaning blade which is protruded from the blade support and can bend also cannot be unambiguously defined because it varies depending upon a balance with an applied pressing force, but is preferably 1 mm to 15 mm, more preferably 2 mm to 10 mm.

Alternatively, the blade can also be produced as follows. A surface of an elastic metal blade such as a spring plate is coated with a coating layer such as resins, rubbers, or elastomers through a coating method or a dipping method, optionally via a coupling agent or a primer component; and optionally subjected to heat-curing and/or surface polishing.

The coating layer contains at least a binder resin and a filler; and, if necessary, further contains other ingredients.

The binder resin is not particularly limited and may be appropriately selected depending on the intended purpose. Examples thereof include fluororesins, such as PFA, PTFE, FEP and PVDF; fluorine-based rubbers; and silicone-based elastomers such as methylphenyl silicone elastomers.

The thickness of the resilient metal blade is not particularly limited and may be appropriately selected depending on the intended purpose, but is preferably 0.05 mm to 3 mm, more preferably 0.1 mm to 1 mm. After being attached, the elastic metal blade can be bended in a direction almost parallel to a support shaft so as to prevent the metal blade from twisting.

The pressing force of the protective layer forming member 24 against the image bearing member 1 is sufficient as long as the image bearing member protecting agent spreads into the protective layer or a protective film. The linear pressure thereof is not particularly limited and may be appropriately selected depending on the intended purpose, but is preferably 5 gf/cm to 80 gf/cm, more preferably 10 gf/cm to 60 gf/cm.

A brush-shaped member can preferably be used as the protecting agent supplying member 22. In this case, fibers of the brush preferably have flexibility so as to reduce mechanical stress applied to the surface of the image bearing member. Materials of the fibers having flexibility are not particularly limited and may be appropriately selected depending on the intended purpose. Examples thereof include polyolefin resins (e.g., polyethylenes and polypropylenes); polyvinyl resins or polyvinylidene resins (e.g., polystyrenes, acrylic resins, polyacrylonitriles, polyvinyl acetates, polyvinyl alcohols, polyvinyl butyrals, polyvinylchlorides, polyvinyl carbazoles, polyvinyl ethers and polyvinyl ketones); polyvinyl-chloride acetate copolymers; styrene-acrylic acid copolymers; styrene-butadiene resins; fluororesins (e.g., polytetrafluoroethylenes, polyvinyl fluorides, polyvinylidene fluorides and polychlorotrifluoroethylenes); polyesters; nylons; acryls; rayons; polyurethanes; polycarbonates; phenolic resins; amino resins (e.g., urea-formaldehyde resins, melamine resins, benzoguanamine resins, urea resins and polyamide resins).

In order to adjust a degree of bending, the above-listed resins can used in combination with rubbers such as diene rubbers, styrene-butadiene rubbers (SBR), ethylene-propylene rubbers, isoprene rubbers, nitrile rubbers, urethane rubbers, silicone rubbers, hydrin rubbers and norbornene rubbers.

The support for the protecting agent supplying member 22 can be a fixed type or a revolvable roll-shaped type. Example of the roll-shaped supplying member includes a roll brush in which a tape made of a pile fabric of the brush fibers is spirally wound around a metal core. The brush fibers suitably have a fiber diameter of about 10 μm to about 500 μm and a length of 1 mm to 15 mm. The brush density is suitably 10,000 fibers/$in^2$ to 300,000 fibers/int ($1.5\times10^7$ fibers/$m^2$ to $4.5\times10^8$ fibers/$m^2$).

The protecting agent supplying member 22 preferably has a high brush density from the viewpoints of uniform and stable supply. One fiber is preferably made of several to hundreds fine fibers. For example, 50 fine fibers of 6.7 decitex (6 denier) may be bundled into one fiber and then implanted, such as 333 decitex=6.7 decitex×50 filaments (300 denier=6 denier x 50 filaments).

A surface of the brush can be coated with a coating layer, if necessary, for the purposes of stabilizing a surface shape of the brush and improving environmental stability. The coating layer preferably contains an ingredient being capable of deforming in response to bending of the brush fibers.

Materials of the ingredient are not particularly limited and may be appropriately selected depending on the intended purpose as long as they can keep flexibility. Examples thereof include polyolefin resins, such as polyethylenes, polypropylenes, chlorinated polyethylenes and chlorosulfonated polyethylenes; polyvinyl resins or polyvinylidene resins, such as polystyrenes, acryls (e.g., polymethylmethacrylate), polyacrylonitriles, polyvinyl acetates, polyvinyl alcohols, polyvinyl butyrals, polyvinylchlorides, polyvinyl carbazoles, polyvinyl ethers and polyvinyl ketones; polyvinyl-chloride acetate copolymers; silicone resins having organosiloxane bonds or modified products thereof (e.g., modified products with alkyd resins, polyester resins, epoxy resins and polyurethane resins); fluororesins, such as perfluoroalkylethers, perfluorovinyls, perfluoro vinylidenes and polychlorotrifluoroethylenes; polyamides; polyesters; polyurethanes; polycarbonates; amino resins such as urea-formaldehyde resins; epoxy resins or composite resins thereof.

(Image Forming Method and Image Forming Apparatus)

The image forming method used in the present invention includes at a least a latent electrostatic image forming step, a developing step, a transfer step, and a protective layer forming step; and, if necessary, further includes appropriately selected other steps such as a cleaning step, a fixing step, a charge-eliminating step, a recycling step, and a control step.

The image forming apparatus of the present invention includes at a least an image bearing member, a latent electrostatic image forming unit, a developing unit, a transfer unit, and a protective layer forming unit; and, if necessary, further includes appropriately selected other units such as a cleaning unit, a fixing unit, a charge eliminating unit, a recycling unit, and a control unit.

The image forming method used in the present invention can be suitably performed by the image forming apparatus of the present invention, the latent electrostatic image forming step can be performed by the latent electrostatic image forming unit, the developing step can be performed by the developing unit, the transfer step can be performed by the transfer unit, the protective layer forming step can be performed by the protective layer forming unit, and the other steps can be performed by the other units.

<Latent Electrostatic Image Forming Step and Latent Electrostatic Image Forming Unit>

The latent electrostatic image forming step is a step of forming a latent electrostatic image on an image bearing member and can be performed by a latent electrostatic image forming unit.

<<Image Bearing Member>>

The image bearing member (hereinafter may be referred to as "latent electrostatic image bearing member" or "photoconductor") is not particularly limited with respect to material, shape, structure, or size, and may be appropriately selected from those known in the art. Suitable example of the shape includes a drum-shape.

The image bearing member is not particularly limited and may be appropriately selected depending on the intended purpose, but preferably includes at least a support and a photoconductive layer thereon; and, if necessary, further includes other layers.

A surface layer can be formed on the photoconductive layer in order to improve mechanical strength, abrasion-resistance, gas-resistance, and cleanability of the image bearing member. An undercoating layer can be provided between the photoconductive layer and the conductive support.

<<<Support>>>

The support is not particularly limited and may be appropriately selected depending on the intended purpose as long as it is electroconductive support having a volume resistance of $1.0\times10^{10}$ Ω·cm or less. Examples thereof include film- or cylinder-shaped plastic or paper coated, through vaporization or sputtering, with metals such as aluminium, nickel, chrome, nichrome, copper, gold, silver and platinum; or metal oxides such as tin oxide and indium oxide. Alternatively, a tube may be used which is obtained by forming a plate of metals such as aluminium, aluminium alloy, nickel or stainless into a drum-shape through extrusion or drawing and then subjecting to surface-treatments such as cutting, superfinishing and polishing.

The diameter of the drum-shaped support is preferably 20 mm to 150 mm, more preferably 24 mm to 100 mm, further preferably 28 mm to 70 mm. When the diameter of the drum-shaped support is smaller than 20 mm, a charging step, an exposing step, a developing step, a transfer step and a cleaning step may be physically difficult to be disposed around the drum. When the diameter is larger than 150 mm, an image forming apparatus may be too large. Especially, in the case of a tandem-type image forming apparatus, a plurality of photoconductors is needed to be mounted, so that the diameter is preferably 70 mm or less, more preferably 60 mm or less.

The endless nickel belt described in JP-A No. 52-36016, or an endless stainless belt can also be used as an electroconductive support.

<<<Photoconductive Layer>>>

The photoconductive layer may have a single layer structure or a laminate structure including a charge generating layer and a charge transporting layer. Particularly preferable is the photoconductive layer having a laminate structure including a charge generating layer and a charge transporting layer.

Firstly, the photoconductive layer having a laminate structure will be explained.

The photoconductive layer having a laminate structure is obtained by sequentially laminating the charge generating layer and the charge transporting layer.

—Charge Generating Layer—

The charge generating layer contains at least a charge generating material, preferably contains a binder resin; and, if necessary, further contains other ingredients.

—Charge Generating Material—

The charge generating material is not particularly limited and may be appropriately selected depending on the intended purpose. Examples thereof include azo pigments such as monoazo pigments, disazo pigments, asymmetric disazo pigments, and triazo pigments; phthalocyanine pigments such as titanyl phthalocyanine, copper phthalocyanine, vanadyl phthalocyanine, hydroxy gallium phthalocyanine, and metal-free phthalocyanine; perylene pigments, perinone pigments, indigo pigments, pyrrolo-pyrrole pigments, anthraquinone pigments, quinacridone pigments, quinone fused polycyclic compounds and squarylium pigments. These may be used alone or in combination.

—Binder Resin—

The binder resin is not particularly limited and may be appropriately selected depending on the intended purpose. Examples thereof include a polyamide resin, a polyurethane resin, an epoxy resin, a polyketone resin, a polycarbonate resin, a silicone resin, an acrylic resin, a polyvinyl butyral resin, a polyvinyl formal resin, a polyvinyl ketone resin, a polystyrene resin, a polysulfone resin, a poly-N-vinylcarbazole resin, a polyacrylamide resin, a polyvinyl benzal resin, a polyester resin, a phenoxy resin, a vinyl chloride-vinyl acetate copolymer, a polyvinyl acetate, a polyphenylene oxide resin, a polyamide resin, a polyvinyl pyridine resin, a polyvinyl alcohol resin, a polyvinyl pyrrolidone resin, a cellulose resin, and casein. These may be used alone or in combination.

An amount of the binder resin is not particularly limited and may be appropriately selected depending on the intended purpose, but is preferably 500 parts by mass or less, more preferably from 10 parts by mass to 300 parts by mass relative to 100 parts by mass of the charge generating material.

The charge generating layer is formed by dissolving or dispersing the charge generating material optionally together with the binder resin into a solvent using known dispersing methods such as a ball mill, an attritor, a sand mill, or ultrasonic waves to obtain a charge generating layer coating liquid, followed by applying the charge generating layer coating liquid onto the support, an undercoat layer or an intermediate layer, and then drying. The binder resin may be added either before or after dispersing the charge generating material.

The solvent is not particularly limited and may be appropriately selected depending on the intended purpose. Examples thereof include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. These may be used alone or in combination. Among them, ketone solvents, ester solvents and ether solvents are particularly preferable.

The charge generating layer coating liquid contains the charge generating material, preferably contains a solvent and a binder resin; and, if necessary, further contains additives such as a sensitizer, a dispersing agent, a surfactant, or silicone oil.

A method for forming the charge generating layer using the charge generating layer coating liquid is not particularly limited and may be appropriately selected depending on the intended purpose. Examples thereof include an immersion coating method, a spray coating, a bead coating, a nozzle coating, a spinner coating and a ring coating.

An average thickness of the charge generating layer is not particularly limited and may be appropriately selected depending on the intended purpose, but is preferably 0.01 μm to 5 μm, more preferably 0.1 μm to 2 μm. After the charge generating layer coating liquid is applied, it is heated and dried by, for example, an oven. The drying temperature of the charge generating layer is preferably 50° C. to 160° C.

—Charge Transporting Layer—

The charge transporting layer contains a charge transporting material and a binder resin; and, if necessary, further contains other ingredients.

—Charge Transporting Material—

The charge transporting material includes a hole transporting material and an electron transporting material.

The hole transporting material is not particularly limited and may be appropriately selected depending on the intended purpose. Examples thereof include poly-N-vinylcarbazole or derivatives thereof, poly-γ-carbazolylethyl glutamate or derivatives thereof, pyrene-formaldehyde condensates or derivatives thereof, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. These may be used alone or in combination.

The electron transporting material is not particularly limited and may be appropriately selected depending on the intended purpose. Examples thereof include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, 1,3,7-trinitrodibenzothiophene-5,5-dioxide and benzoquinone derivatives. These may be used alone or in combination.

An amount of the charge transporting material is not particularly limited and may be appropriately selected depending on the intended purpose, but preferably is 20 parts by mass to 300 parts by mass, more preferably 40 parts by mass to 150 parts by mass relative to 100 parts by mass of the binder resin.

—Binder Resin—

The binder resin is not particularly limited and may be appropriately selected depending on the intended purpose. Examples thereof include polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate, ethyl cellulose, polyvinyl butyral, polyvinyl formal, polyvinyl toluene, poly(N-vinylcarbazole), acrylic resin, silicone resin, epoxy resin, melamine resins, urethane resins, phenol resins and alkyd resins. These may be used alone or in combination.

The charge transporting layer is formed by dissolving or dispersing the charge transporting material together with the binder resin into a solvent to obtain a charge transporting layer coating liquid, followed by applying the charge transporting layer coating liquid onto a support or an undercoat layer, and then drying. The charge transporting layer coating liquid, if necessary, further contains additives such as a plasticizer, a leveling agent, an antioxidant and a glidant.

Examples the solvent include tetrahydrofuran, dioxane, toluene, dichloromethane, monochlorobenzene, dichloroethane, cyclohexanone, methyl ethyl ketone, and acetone. These may be used alone or in combination. Among them, preferred is a non-halogen solvent, and particularly preferred are cyclic ethers such as tetrahydrofuran, dioxolane and dioxane, aromatic hydrocarbons such as toluene and xylene, or derivatives thereof from the viewpoint of reducing environmental load.

The method for applying the charge transporting layer coating liquid is not particularly limited and may be appropriately selected depending on the intended purpose. Examples thereof include an immersion coating method, a spray coating method, a bead coating method, a nozzle coating method, a spinner coating method, and a ring coating method. Among them, an immersion coating method is preferred because the charge transporting layer should be thick to a certain degree.

After the charge transporting layer is formed, it is heated and dried by a heating unit such as an oven. The drying temperature is not particularly limited and may be appropriately selected depending on the intended purpose, but is preferably 80° C. to 200° C., more preferably 110° C. to 170° C. The drying time is not particularly limited and may be appropriately selected depending on the intended purpose, but is preferably 10 min or more, more preferably 20 min or more.

An average thickness of the charge transporting layer is not particularly limited and may be appropriately selected depending on the intended purpose, but is preferably 10 μm to 50 μm, more preferably 15 μm to 35 μm from the viewpoints of resolution and responsiveness.

<<<Photoconductive Layer Having a Single Layer Structure>>>

The photoconductive layer having a single layer structure is formed by dispersing or dissolving a charge generating material and a charge transporting material into a binder resin; and both of a charge generating function and charge transporting function are exerted by the single layer.

As for the charge generating materials, charge transporting materials, binder resins, solvents and various additives used in the photoconductive layer having a single layer structure, any materials contained in the charge generating layer and the charge transporting layer can be used.

The charge transporting material preferably contains both of a hole transporting material and an electron transporting material; and, if necessary, further contains, for example, a plasticizer, a levelling agent and an antioxidant.

As for the binder resin, the binder resins exemplified with respect to the charge generating layer may be mixed in addition to the binder resins exemplified with respect to the charge transporting layer. The amount of the charge generating material is not particularly limited and may be appropriately selected depending on the intended purpose, but is preferably 5 parts by mass to 40 parts by mass, more preferably 10 parts by mass to 30 parts by mass relative to 100 parts by mass of the binder resin. The amount of the charge transporting material is not particularly limited and may be appropriately selected depending on the intended purpose, but is preferably 0 parts by mass to 190 parts by mass, more preferably 50 parts by mass to 150 parts by mass.

The photoconductive layer having a single layer structure is formed by dissolving or dispersing the charge generating material, the charge transporting material and the binder resin into a solvent such as tetrahydrofuran, dioxane, dichloroethane, methyl ethyl ketone, cyclohexane, cyclohexanone, toluene, and xylene, followed by applying using known methods such as immersion coating method, a spray coating, a bead coating, or a ring coating.

An average thickness of the photoconductive layer having a single layer structure is not particularly limited and may be appropriately selected depending on the intended purpose, but is preferably 5 μm to 40 μm, more preferably 10 μm to 30 μm.

<<<Undercoating Layer>>>

An undercoating layer included in the photoconductor may be a single layer or a laminate. Examples thereof include (1) those mainly containing a resin, (2) those mainly containing a white pigment and a resin, and (3) a metal oxide film obtained by chemically or electrochemically oxidizing a surface of an electroconductive base. Among them, preferred are those mainly containing a white pigment and a resin.

Examples of the white pigment include metal oxides, such as titanium oxide, aluminum oxide, zirconium oxide and zinc oxide. Among them, titanium oxide is particularly preferable because it is suitable for preventing charges from being injected from the electroconductive base Examples of the resin include thermoplastic resins such as polyamide, polyvinyl alcohol, casein and methylcellulose; and thermosetting resins, such as acrylic, phenolic, melamine, alkyd, unsaturated polyester and epoxy resins. These may be used alone or in combination.

A thickness of the undercoating layer is not particularly limited and may be appropriately selected depending on the intended purpose, but is preferably 0.1 μm to 10 more preferably 1 μm to 5 μm.

<<<Surface Layer>>>

The surface layer is provided in order to improve mechanical strength, abrasion-resistance, gas-resistance, and cleanability of the photoconductor. The surface layer is suitably polymers having mechanical strength higher than that of the photoconductive layer or polymers into which inorganic filler has been dispersed.

Furthermore, the resin used for the surface layer may be thermoplastic resins or thermosetting resins. However, the thermosetting resins are particularly preferable from the viewpoints of high mechanical strength and extremely high ability for preventing abrasion caused by friction between the photoconductor and the cleaning blade. In the case of a thin surface layer, the surface layer may not have a charge transporting ability, which is not problematic. However, a thick surface layer having no charge transporting ability may lead to sensitivity reduction of the photoconductor, potential increase after exposing and residual potential increase. Accordingly, it is preferred that the surface layer contains the charge transporting material or that polymers having a charge transporting ability are used for the surface layer.

Generally, mechanical strength of the photoconductive layer is greatly different from that of the surface layer. Therefore, when the surface layer is abraded and removed through friction with the cleaning blade, the photoconductive layer would be immediately abraded. Accordingly, in the case where the surface layer is provided, it should have sufficient thickness.

The thickness of the surface layer is not particularly limited and may be appropriately selected depending on the intended purpose, but is preferably 0.1 μm to 12 μm, more preferably 1 μm to 10 μm, further preferably 2 μm to 8 μm. When the thickness is less than 0.1 μm, the surface layer is so thin that it tends to be partially removed through friction with the cleaning blade, which may cause abrasion of the photoconductive layer at an area the surface layer has been removed. When the thickness is more than 12 μm, sensitivity reduction of the photoconductor, potential increase after exposing and residual potential increase tend to be caused. Particularly, in the case where polymers having charge transporting ability are used, the polymers having charge transporting ability may increase costs.

Resins used for the surface layer preferably are transparent to writing light used during image formation and excellent in insulation property, mechanical strength and adhesiveness. Examples thereof include ABS resin, ACS resin, olefin-vinyl-monomer copolymer, chlorinated polyether, allyl resin, phenol resin, polyacetal, polyamide, polyamide-imide, polyacrylate, polyallylsulfone, polybutylene, polybutylene terephthalate, polycarbonate, polyether sulfone, polyethylene, polyethylene terephthalate, polyimide, acrylic resin, polymethyl pentene, polypropylene, polyphenylene oxide, polysulfone, polystyrene, AS resin, butadiene-styrene copolymer, polyurethane, polyvinylchloride, polyvinylidene chloride, and epoxy resin. These polymers may be thermoplastic resins, but in order to enhance the mechanical strength of polymers, they can be cross-linked with a cross-linking agent having polyfunctional acryloyl groups, carboxyl groups, hydroxyl groups, or amino groups to form thermosetting resins, which can enhance mechanical strength of the surface layer and greatly reduce abrasion through frictions with the cleaning blade.

The surface layer preferably has charge transporting ability. Examples of a method for imparting the charge transporting ability to the surface layer include a method in which polymers used for the surface layer are mixed with the above-described charge transporting materials, and a method in which polymers having charge transporting ability are used in the surface layer. The latter method is preferable because it can produce a photoconductor having higher sensitivity, less potential increase after exposing and less residual potential increase.

As for the polymers having charge transporting ability, example of a group having charge transporting ability contained in the polymers includes a group represented by the following General Formula (i).

<General Formula (i)>

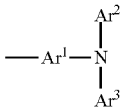

In the General Formula (i), $Ar^1$ denotes an optionally substituted arylene group; and Are and Ara may be the same or different, and each denotes an optionally substituted aryl groups.

The group having charge transporting ability is preferably attached to a side chain of polymers having high mechanical strength such as polycarbonate resins and acrylic resins. Particularly preferable are acrylic resins because monomers therein can be easily produced and they are excellent in coating and curing properties.

Such acrylic resins having charge transporting ability can form a surface layer having high mechanical strength, excellent transparency and high charge transporting ability by incorporating unsaturated carboxylic acids having a group represented by the General Formula (i). When a monofunctional unsaturated carboxylic acid having the group represented by the General Formula (i) is mixed with a polyfunctional unsaturated carboxylic acid, preferably a trifunctional or higher unsaturated carboxylic acid, the acrylic resin forms cross-linked structures to thereby be a thermosetting polymer, which can produce a surface layer having extremely high mechanical strength. The group represented by the General Formula (i) may be attached to the polyfunctional unsaturated carboxylic acid, however, in terms of monomer production cost, photocurable polyfunctional monomers are preferably used instead of polyfunctional unsaturated carboxylic acid to which the group represented by the General Formula (i) is attached.

Examples of monofunctional unsaturated carboxylic acids having the group represented by the General Formula (i) are represented by the following General Formula (ii) or General Formula (iii).

<General Formula (ii)>

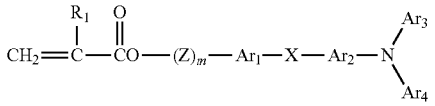

<General Formula (iii)>

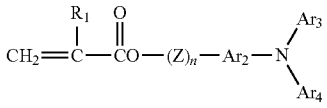

In the General Formula (ii) and the General Formula (iii), $R_1$ denotes a hydrogen atom, a halogen atom, an optionally substituted alkyl group, an optionally substituted aralkyl group, an optionally substituted aryl group, a cyano group, a nitro group, an alkoxy group, —$COOR_7$ (where $R_7$ represents a hydrogen atom, an optionally substituted alkyl group, an optionally substituted aralkyl group, or an optionally substituted aryl group), a halogenated carbonyl group, or $CONR_8R_9$ (where $R_8$ and $R_9$ may be the same or different and each denotes a hydrogen atom, a halogen atom, an optionally substituted alkyl group, an optionally substituted aralkyl group, or an optionally substituted aryl group).

In the General Formula (ii) and the General Formula (iii), $Ar_1$ and $Ar_2$ may be the same or different and each denotes an optionally substituted arylene group.

In the General Formula (ii) and the General Formula (iii), Ara and $Ar_4$ may be the same or different and each denotes an optionally substituted aryl group.

In the General Formula (ii) and the General Formula (iii), X denotes a single bond, an optionally substituted alkylene group, an optionally substituted cycloalkylene group, an optionally substituted alkylene ether group, an oxygen atom, a sulfur atom or a vinylene group.

In the General Formula (ii) and the General Formula (iii), Z denotes an optionally substituted alkylene group, an optionally substituted bivalent alkylene ether group, or a bivalent alkyleneoxycarbonyl group.

In the General Formula (ii) and the General Formula (iii), m and n each denotes an integer in the range of 0 to 3.

As for a substituent $R_1$ in the General Formula (ii) and General Formula (iii), examples of alkyl groups include a methyl group, an ethyl group, a propyl group and a butyl group. Examples of aryl groups include a phenyl group and a naphthyl group. Examples of aralkyl groups include a benzyl group, a phenethyl group and a naphthylmethyl group. Examples of alkoxy groups include a methoxy group, an ethoxy group and a propoxy group. These may be substituted with a halogen atom; a nitro group; a cyano group; an alkyl group such as a methyl group and an ethyl group; an alkoxy group such as a methoxy group and an ethoxy group; an aryloxy group such as a phenoxy group; a aryl group such as a phenyl group and a naphthyl group; an aralkyl group such as a benzyl group and a phenethyl group. Of these substituents for $R_1$, a hydrogen atom and a methyl group are particularly preferable.

Example of the optionally substituted $Ar_3$ and $Ar_4$ includes an aryl group. Examples of the aryl group include fused polycyclic hydrocarbon groups, non-fused cyclic hydrocarbon groups and heterocyclic groups.

The fused polycyclic hydrocarbon groups preferably have 18 or less ring-forming carbon atoms. Examples thereof include a pentanyl group, an indenyl group, a naphthyl group, an azulenyl group, a heptalenyl group, a biphenylenyl group, an as-indacenyl group, a s-indacenyl group, a fluorenyl group, an acenaphthylenyl group, a praadenyl group, an acenaphthenyl group, a phenalenyl group, a phenanthryl group, an anthryl group, a fluoranethenyl group, an acephenanthrylenyl group, an aceanthrylenyl group, a triphenylenyl group, a pyrenyl group, a crysenyl group and a naphthacenyl group.

Examples of the non-fused cyclic hydrocarbon groups include a monovalent group in monocyclic hydrocarbon compounds such as benzene, diphenyl ether, polyethylene diphenylether, diphenylthioether and diphenyl sulfone; a monovalent group in non-fused polycyclic hydrocarbon compounds such as biphenyl, polyphenyl, diphenylalkane, diphenylalkene, diphenylalkyne, triphenylmethane, distyrylbenzene, 1,1-diphenyl cycloalkane, polyphenylalkane and polyphenylalkene; a monovalent group in cyclic hydrocarbon compounds such as 9,9-diphenyl fluorene.

Examples of the heterocyclic groups include a monovalent group such as carbazole, dibenzofuran, dibenzothiophene, oxadiazole and thiadiazole.

An amount of the polyfunctional unsaturated carboxylic acid is not particularly limited and may be appropriately selected depending on the intended purpose, but is preferably 5% by mass to 75% by mass, more preferably 10% by mass to 70% by mass, further preferably 20% by mass to 60% by mass relative to the total amount of the surface layer. When the amount is less than 5% by mass, the surface layer is insufficient in mechanical strength. When the amount is more than 75% by mass, cracks tend to be occurred on the surface layer when a strong force applied thereon, and sensitivity may be easily deteriorated.

In the case of using an acrylic resin for a surface layer, the surface layer can be formed by applying the unsaturated carboxylic acid onto a photoconductor, followed by allowing to radical-polymerize through irradiation of electron beam or active ray such as ultraviolet. When the active ray is irradiated, an unsaturated carboxylic acid in which a photopolymerization initiator is dissolved is used. The photopolymerization initiator may be materials generally used for photocurable coating.

Metal particles or metal oxide particles may be dispersed into the surface layer in order to enhance mechanical strength of the surface layer. The metal oxides are not particularly limited and may be appropriately selected depending on the intended purpose. Examples of the metal oxides include titanium oxide, tin oxide, potassium titanate, TiO, TiN, zinc oxide, indium oxide, and antimony oxide.

Other ingredients (e.g., fluororesins such as polytetrafluoroethylene, silicone resins or those in which inorganic materials are dispersed into the above-listed resins) may be added in order to enhance abrasion-resistance.

In the image bearing member, additives such as an antioxidant, a plasticizer, a glidant, an ultraviolet absorbing agent, a low-molecular weight charge transporting material, and a leveling agent may be added to the charge generating layer, the charge transporting layer, the undercoating layer, or the surface layer, for the purpose of improving resistance to environment, in particular, preventing sensitivity reduction and residual potential increase.

A latent electrostatic image can be formed, for example, by uniformly charging the surface of the image bearing member and then imagewise-exposing the surface by means of the latent electrostatic image forming unit. The latent electrostatic image forming unit includes at least a charger configured to uniformly charge the surface of the image bearing member, and an exposing device configured to imagewise-expose the surface of the image bearing member.

The charging can be performed by applying a voltage to the surface of the image bearing member using, for example, the charger.

The charger is not particularly limited and may be appropriately selected depending on the intended purpose. Examples thereof include contact chargers known in the art which are equipped with, for example, an electroconductive or semi-electroconductive roller, a brush, a film, or a rubber blade; and non-contact chargers utilizing corona discharge such as corotron and scorotron.

The charger preferably includes a voltage applying unit configured to apply voltage having an alternate current component The exposing can be performed by imagewise-exposing the surface of the image bearing member using the exposing device.

The exposing device is not particularly limited and may be appropriately selected depending on the intended purpose, as long as it can imagewise-expose the surface of the image bearing member which has been charged by the charger. Examples thereof include exposing devices such as copying optical systems, rod lens array systems, laser optical systems, and liquid crystal shutter optical systems.

<Developing Step and Developing Unit>

The developing step is a step of developing the latent electrostatic image with a toner or a developer to thereby form a visible image.

The visible image can be formed by developing the latent electrostatic image with the toner or the developer. The visible image can be formed by the developing unit.

The developing unit is not particularly limited and may be appropriately selected from those known in the art, as long as it can develop a latent electrostatic image with the toner or the developer. Preferred examples thereof include those including at least a developing device which contains the toner or the developer therein and enables supplying the toner or the developer to the latent electrostatic image in a contact or non-contact manner.

<<Toner>>

The toner is not particularly limited and may be appropriately selected depending on the intended purpose. An average circularity, which is an average value of circularity SR represented by the following Equation 1, of the toner is preferably 0.93 to 1.00, more preferably 0.95 to 0.99. The average circularity indicates the degree of the unevenness on the surface of toner particles. When toner particles have perfectly spherical shapes, the average circularity is 1.00, and when toner particles have more complicated surface profiles, the average circularity becomes smaller.

Circularity $SR$=(Circumference length of circle having the same area as projected area of toner particle)/(Circumference length of projected image of toner particle) <Equation 1>

When the average circularity is in the range of 0.93 to 1.00, the toner particles have smooth surfaces, and have good transferability because of having a small contact area with another toner particles or a photoconductor. Furthermore, the toner particles have no corners, so that such toner particles do not produce abnormal images because they can be stably agitated in the developing device with only a small agitation torque. Moreover, there is no angular toner particle among toner particles for forming dots, so that the toner particles can be uniformly pressed against a recording medium during the transfer step, which can prevent transfer voids during the transfer step. Moreover, the toner particles are not angular, so that they have only a low polishing ability and do not scratch or abrade the surface of the photoconductor.

The circularity SR can be measured with, for example, a flow-type particle image analyzer (FPIA-1000, product of SYSMEX CORPORATION).

Firstly, 0.1 mL to 0.5 mL of a surfactant (preferably alkylbenzene sulfonate) is added as a dispersing agent to 100 mL to 150 mL of water, from which solid impurities have been removed in advance, contained in a vessel. And then, 0.1 g to 0.5 g of a measurement sample is added thereto and dispersed therein to thereby obtain a suspension liquid. The suspension liquid is dispersed with an ultrasonic disperser for about 1 min to about 3 min, and then the toner particles are measured for shape and particle diameter using the analyzer at the concentration of 3,000 particles/4, to 10,000 particles/μL.

The weight average particle diameter (D4) of the toner is not particularly limited and may be appropriately selected depending on the intended purpose, but is preferably 3 μm to 10 μm, more preferably 4 μm to 8 μm. When the weight average particle diameter falls within the range, the toner can be excellent in dot reproducibility because the toner particles have sufficiently small particle diameters relative to that of fine latent-image dots. When the weight average particle diameter (D4) is smaller than 3 μm, transfer efficiency and blade cleanability may be easily deteriorated. When the weight average particle diameter is larger than 10 μm, ink-splattering in lines and letters may be difficult to be suppressed.

Furthermore, the ratio (D4/D1) of the weight average particle diameter (D4) to the number average particle diameter (D1) of the toner particles is not particularly limited and may be appropriately selected depending on the intended purpose, but is preferably 1.00 to 1.40, more preferably 1.00 to 1.30. The closer to 1.00 the ratio (D4/D1) is, the sharper the particle size distribution of the toner particles is. When the ratio (D4/D1) is 1.00 to 1.40, the toner particles are not selected based on their particle diameters, so that the toner can provide excellent image stability. Owing to the sharpness of particle size distribution, the toner has a sharp friction charged quantity distribution as well to thereby prevent production of foggy images. Further, toner particles having a uniform particle diameter have excellent dot reproducibility because the toner particles are precisely and orderly developed on latent-image dots.

The weight average particle diameter (D4) of the toner and its particle size distribution can be measured with, for example, a Coulter-counter-method. Examples of measurement devices used in the Coulter-counter-method for measuring particle size distributions of toner particles include COULTER COUNTER TA-II or COULTER MULTISIZER II (both product of Coulter Electronics, Inc.).

Firstly, 0.1 mL to 5 mL of a surfactant (preferably alkylbenzene sulfonic acid salt) is added as a dispersing agent to 100 mL to 150 mL of an electrolyte aqueous solution. Herein, the electrolyte aqueous solution is an about 1% by mass NaCl aqueous solution prepared using a primary sodium chloride such as ISOTON-II (product of Coulter electronics, Inc.). Then, 2 mg to 20 mg of a measurement sample is further added thereto and dispersed therein to thereby obtain a suspension liquid. The suspension liquid is dispersed with an ultrasonic disperser for about 1 min to about 3 min. A weight and the number of toner particles or toner are measured with each of the following channels using an aperture of 100 μm to thereby determine a weight distribution and a number distribution. Based on the measured weight distribution and number distribution, the weight average particle diameter (D4) and the number average particle diameter (D1) can be determined.

The following 13 channels are used: 2.00 μm or more but less than 2.52 μm: 2.52 μm or more but less than 3.17 μm: 3.17 μm or more but less than 4.00 μm: 4.00 μm or more but less than 5.04 μm: 5.04 μm or more but less than 6.35 μm; 6.35 μm or more but less than 8.00 μm: 8.00 μm or more but less than 10.08 μm: 10.08 μm or more but less than 12.70 μm; 12.70 μm or more but less than 16.00 μm: 16.00 μm or more but less than 20.20 μm: 20.20 μm or more but less than 25.40 μm: 25.40 μm or more but less than 32.00 μm: and 32.00 μm or more but less than 40.30 μm, and particles having particle diameters of 2.00 μm or more but less than 40.30 μm are measured.

The toner is not particularly limited and may be appropriately selected depending on the intended purpose. For example, the toner can be produced through a cross-linking or an elongation reaction of toner materials containing at least a prepolymer made of a modified polyester resin, an unmodified polyester, a colorant, and a releasing agent, in an aqueous medium in the presence of resin particles.

Example of the prepolymer made of a modified polyester resin includes a polyester prepolymer having an isocyanate group (A), and example of a compound to be elongated and/or crosslinked with the prepolymer includes amines (B).

Example of the polyester prepolymer having an isocyanate group (A) includes those obtained from a reaction of polyester, which are a polycondensation product between polyols (1) and polycarboxylic acids (2) and has active hydrogen groups, with polyisocyanates (3). Examples of the active hydrogen group contained in the polyester include a hydroxyl group (an alcoholic hydroxyl group and a phenolic hydroxyl group), an amino group, a carboxyl group, and a mercapto group. Among them, the alcoholic hydroxyl group is particularly preferable.

Examples of the polyols (1) include diols (1-1), trivalent or higher polyols (1-2), and (1-1) alone or a mixture of (1-1) and a small amount of (1-2) is preferable.

Examples of the diols (1-1) include alkyleneglycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexanedimethanol, and hydrogenated bisphenol A); bisphenols (e.g., bisphenol A, bisphenol F, and bisphenol S); adducts of the above-listed alicyclic diol with an alkylene oxide (e.g., ethyleneoxide, propyleneoxide, and butyleneoxide); and adducts of the above-listed bisphenol with an alkylene oxide (e.g., ethyleneoxide, propyleneoxide, and butyleneoxide). Among them, alkyleneglycols having 2 to 12 carbon atoms and adducts of bisphenol with an alkylene oxide are preferable, and a combination of adducts of bisphenol with an alkylene oxide and alkyleneglycols having 2 to 12 carbon atoms is particularly preferable.

Examples of the trivalent or higher polyols (1-2) include trihydric to octahydric or higher polyhydric aliphatic alcohols (e.g., glycerine, trimethylolethane, trimethylolpropane, pentaerythritol and sorbitol); trihydric or higher phenols (e.g., trisphenol PA, phenol novolac, and cresol novolac); and adducts of the trihydric or higher polyphenols with alkylene oxide.

Examples of the polycarboxylic acids (2) include dicarboxylic acids (2-1) and trivalent or higher polycarboxylic acids (2-2). Among them, (2-1) alone or a mixture of (2-1) and a small amount of (2-2) is preferable.

Examples of the dicarboxylic acids (2-1) include alkylene dicarboxylic acids (e.g., succinic acid, adipic acid, and sebacic acid); alkenylene dicarboxylic acids (e.g., maleic acid, and fumaric acid); aromatic dicarboxylic acids (e.g., phthalic acid, isophthalic acid, terephthalic acid, and naphthalene dicarboxylic acid). Among them, alkenylene dicarboxylic acids having 4 to 20 carbon atoms and aromatic dicarboxylic acids having 8 to 20 carbon atoms are particularly preferable.

Examples of the trivalent or higher polycarboxylic acids (2-2) include aromatic polycarboxylic acids having 9 to 20 carbon atoms (e.g., trimellitic acid and pyromellitic acid). Polycarboxylic acids (2) may be reacted with polyol (1) using above-listed acid anhydride or lower alkyl ester (e.g., methyl ester, ethyl ester, and isopropyl ester).

A ratio of the polyols (1) to the polycarboxylic acids (2) is not particularly limited and may be appropriately selected depending on the intended purpose, but an equivalent ratio [OH]/[COOH] of hydroxyl groups [OH] to carboxyl groups [COOH] is preferably 2/1 to 1/1, more preferably 1.5/1 to 1/1, further preferably 1.3/1 to 1.02/1. Examples of the polyisocyanates (3) include aliphatic polyisocyanates (e.g., tetramethylene diisocyanate, hexamethylene diisocyanate, and 2,6-diisocyanatomethylcaproate); alicyclic polyisocyanates (e.g., isophorone diisocyanate, and cyclohexylmethane diisocyanate); aromatic diisocyanates (e.g., tolylene diisocyanate, and diphenylmethane diisocyanate); aromatic-aliphatic diisocyanates (e.g., α,α,α',α'-tetramethylxylylene diisocyanate); isocyanurates; and the above-listed polyisocyanates blocked with phenol derivatives, oximes, or caprolactams. These may be used alone or in combination.

With respect of the ratio of the polyisocyanates (3), an equivalent ratio [NCO]/[OH] of isocyanate groups [NCO] to hydroxyl groups in polyester having hydroxyl groups [OH] is preferably 5/1 to 1/1, more preferably 4/1 to 1.2/1, further preferably 2.5/1 to 1.5/1. When the equivalent ratio [NCO]/[OH] is more than 5, low temperature fixability may be degraded, and when a molar ratio of the [NCO] is less than 1, hot offset resistance may be deteriorated because of low urea content in the modified polyester.

An amount of components of the polyisocyanate (3) contained in the prepolymer having a terminal isocyanate group (A) is not particularly limited and may be appropriately selected depending on the intended purpose, but is preferably 0.5% by mass to 40% by mass, more preferably 1% by mass to 30% by mass, further preferably 2% by mass to 20% by mass. When the amount is less than 0.5% by mass, the hot offset resistance of the resultant toner degrades, and the toner has difficulty in concurrently satisfying heat resistance and low-temperature fixability. When the amount is more than 40% by mass, the low-temperature fixability of the resultant toner may degrade.

The number of isocyanate groups per one molecule of the prepolymer having an isocyanate group (A) is not particularly limited and may be appropriately selected depending on the intended purpose, but is preferably 1 or more on average, more preferably 1.5 to 3 on average, further preferably 1.8 to 2.5 on average. When the number of isocyanate groups per one molecule is less than 1, the molecular weight of the urea-modified polyester decreases and hot offset resistance of the resultant toner degrades.

Examples of the amines (B) include diamines (B1), trivalent or higher polyamines (B2), amino alcohols (B3), aminomercaptans (B4), amino acids (B5), and blocked amines (B6) in which amino groups in the amines (B1) to (B5) are blocked.

Examples of diamines (B1) include aromatic diamines (phenylenediamine, diethyltoluenediamine, 4,4'diaminodiphenylmethane); alicyclic diamines (e.g., 4,4'-diamino-3, 3'dimethyldicyclohexylmethane, diamine cyclohexane, and isophorone diamine); and aliphatic diamines (e.g., ethylene diamine, tetramethylenediamine, and hexamethylenediamine).

Examples of trivalent or higher polyamines (B2) include diethylenetriamine and triethylenetetramine.

Examples of amino alcohols (B3) include ethanolamine and hydroxyethylaniline.

Examples aminomercaptans (B4) include aminoethylmercaptan and aminopropylmercaptan.

Examples of amino acids (B5) include aminopropionic acid and aminocaproic acid.

Examples of blocked amines (B6) in which amino groups in the amines (B1) to (B5) are blocked include ketimine compounds obtained by reacting any one of amines (B1) to (B5) with ketones (e.g., acetone, methyl ethyl ketone, and methyl isobutyl ketone) and oxazoline compounds.

Among these amines (B), (B1) alone or a mixture of (B1) and a small amount of (B2) are preferable.

Furthermore, the molecular weight of urea-modified polyester can optionally be controlled using an elongation terminator, if desired. Examples of elongation terminators include monoamines (e.g., diethylamine, dibutylamine, butylamine, and laurylamine), and blocked products thereof (e.g., ketimine compounds).

With respect of the ratio of the amines (B), an equivalent ratio [NCO]/[NHx] of isocyanate groups [NCO] in prepolymer having an isocyanate group (A) to amino groups [NHx] in amines (B), is preferably 1/2 to 2/1, more preferably 1.5/1 to 1/1.5, further preferably 1.2/1 to 1/1.2. When the ratio [NCO]/[NHx] is more than 2 or less than ½, the molecular weight of the urea-modified polyester (i) decreases, resulting in degradation of hot offset resistance of the resultant toner.

The urea-modified polyester modified with a urea bond (i) may contain a urethane bond in addition to the urea bond. The molar ratio of the urea bond content to the urethane bond content is preferably 100/0 to 10/90, more preferably 80/20 to 20/80, further preferably 60/40 to 30/70. When the molar ratio of the urea bonds is less than 10%, hot offset resistance of the resultant toner may degrade.

Through the above reactions, the modified polyester for use in the toner, in particular, a urea-modified polyester (i) can be prepared. The urea-modified polyesters (i) can be produced through a one-shot method or a prepolymer method.

The weight average molecular weight of the urea-modified polyester (i) is preferably 10,000 or more, more preferably 20,000 to 10,000,000, further preferably 30,000 to 1,000,000. When the weight average molecular weight is less than 10,000, hot offset resistance of the resultant toner may degrade.

The number average molecular weight of the urea-modified polyester (i) is not particularly limited and may be appropriately selected depending on the intended purpose, as long as the after-mentioned unmodified polyester is used, and the above-mentioned weight average molecular weight can be easily obtained. When the urea-modified polyester (i) is used alone, the number average molecular weight is preferably less than 20,000, and more is preferably 1,000 to 10,000, further preferably 2,000 to 8,000. When the number average molecular weight is more than 20,000, the low temperature fixability, as well as the glossiness when used in a full color image forming apparatus may degrade.

In the present invention, an unmodified polyester (ii) can be used in combination with the urea-modified polyester (i) as a toner binder resin. It is more preferable to use the unmodified polyester (ii) in combination with the modified polyester than to use the urea-modified polyester alone, because low-temperature fixability as well as the glossiness when used in a full color image forming apparatus are improved. Specific examples of the unmodified polyester (ii) include polycondensed products between the polyols (1) and polycarboxylic acids (2) similar to those described with respect to the urea-modified polyester (i), and the have preference similar to (i). Further, in addition to the unmodified polyester, those modified with chemical bonds other than the urea bond (e.g., a urethane bond) can be used for (ii). It is preferable that the urea-modified polyester (i) and the unmodified polyester (ii) are at least partially compatible with each other from the viewpoints of the low-temperature fixability and hot offset resistance of the resultant toner.

Therefore, the polyester components in the urea-modified polyester (i) preferably have a similar composition to the unmodified polyester (ii). In the case where (ii) is contained, the mass ratio of (i) to (ii) is not particularly limited and may be appropriately selected depending on the intended purpose, but is preferably 5/95 to 80/20, more preferably 5/95 to 30/70, further preferably 5/95 to 25/75, particularly preferably 7/93 to 20/80. When the mass ratio of (i) is less than 5% by mass, the resultant toner has poor hot offset resistance, and may have difficulty in concurrently satisfying heat resistant storage stability and low-temperature fixability.

The peak molecular weight of the unmodified polyester (ii) is not particularly limited and may be appropriately selected depending on the intended purpose, but is preferably 1,000 to 30,000, more preferably 1,500 to 10,000, further preferably 2,000 to 8,000. When the peak molecular weight is less than 1,000, heat-resistant storage stability may be degraded, and when the peak molecular weight is more than 10,000, low-temperature fixability may be degraded.

A hydroxyl value of the unmodified polyester (ii) is not particularly limited and may be appropriately selected depending on the intended purpose, but is preferably 5 mgKOH/g or more, more preferably 10 mgKOH/g to 120 mgKOH/g, further preferably 20 mgKOH/g to 80 mgKOH/g. When the hydroxyl value is less than 5 mgKOH/g, the resultant toner may have difficulty in concurrently satisfying heat resistant storage stability and low-temperature fixability.

An acid value of the unmodified polyester (ii) is not particularly limited and may be appropriately selected depending on the intended purpose, but is preferably 1 mgKOH/g to 30 mgKOH/g, more preferably 5 mgKOH/g to 20 mgKOH/g, which allows the resultant toner to be negatively charged.

The glass-transition temperature (Tg) of the unmodified polyester (ii) is not particularly limited and may be appropriately selected depending on the intended purpose, but is preferably 50° C. to 70° C., more preferably 55° C. to 65° C. When the glass-transition temperature is less than 50° C., the blocking resistance of the resulting toner may degrade during storage at high temperature, and when the glass-transition temperature is more than 70° C., low-temperature fixability may be insufficient. When the urea-modified-polyester resin is used in combination with the unmodified polyester, as compare to known polyester toners, the toner of the present invention has excellent heat resistant storage stability even when the glass-transition temperature is low.

The urea-modified polyester can be as follows. Firstly, the above-listed polyols (1) and the above-listed poly carboxylic acids (2) are heated to a temperature of 150° C. to 280° C. in the presence of esterifying catalysts such as tetrabutoxy titanate and dibutyltin oxide. Then, water generated is removed, under a reduced pressure if desired, to prepare a polyester having a hydroxyl group. Then, the polyester is reacted with the polyisocyanates (3) at a temperature of 40° C. to 140° C. to obtain a prepolymer having an isocyanate group (A). Further, the prepolymer (A) is reacted with amines (B) at a temperature of 0° C. to 140° C. to obtain an urea-modified polyester. When the polyisocyanate (3) is reacted and when the prepolymer (A) are reacted with the amines (B), a solvent can also be used if desired.

The solvent is not particularly limited and may be appropriately selected depending on the intended purpose. Examples thereof include those are inactive to the isocyanates (3), such as aromatic solvents (e.g., toluene, and xylene); ketones (e.g., acetone, methyl ethyl ketone, and methyl isobutyl ketone); esters (e.g., ethyl acetate); amides (e.g., dimethylformamide, and dimethylacetamide) and ethers (e.g., tetrahydrofuran).

When the unmodified polyester (ii) (i.e. a polyester not modified with urea bonds) is used in combination with the urea-modified polyester, a method similar to a method for preparing a polyester having a hydroxyl group is used to prepare the unmodified polyester (ii). The resultant unmodified polyester is dissolved and mixed in a solution after a reaction of the urea-modified polyester (i) is completed.

The toner can be prepared by, but is not limited to, the following method.

The toner may be prepared by allowing a dispersion including the prepolymer having an isocyanate group (A) to react with the amines (B) in an aqueous medium, or may use a previously prepared urea-modified polyester (i). Example of a method for stably preparing a dispersion formed of the urea-modified polyester (i) and the prepolymer (A) in an aqueous medium, a method in which a toner composition formed of the urea-modified polyester (i) and the prepolymer (A) is added to an aqueous medium and dispersed thereinto upon application of shear stress is preferably used.

The prepolymer (A), and other toner components (hereinafter may be referred to as toner materials) such as colorants, master batch pigments, releasing agents, charge controlling agents and unmodified polyester may be added into an aqueous medium at the same time when the dispersion is prepared. However, it is preferable that the toner materials are previously mixed, and then are added to the aqueous medium and dispersed thereinto. In addition, in the present invention, other toner materials such as colorants, releasing agents, and charge controlling agents are not necessarily added to the aqueous medium before particles are formed, and may be added thereto after particles are prepared in the aqueous medium. For example, after forming particles without colorants, a colorant can also be added thereto by known dying methods.

The aqueous medium may be water alone, or a mixture of water with a water-miscible solvent. Examples of the water-miscible solvent include alcohols (e.g. methanol, isopropanol and ethylene glycol); dimethylformamide; tetrahydrofuran; cellosolves (e.g. methyl cellosolve); and lower ketones (e.g. acetone and methyl ethyl ketone).

The amount of the aqueous medium relative to the 100 parts by mass of toner materials including the urea-modified polyester (i) or the prepolymer (A) is not particularly limited and may be appropriately selected depending on the intended purpose, but is preferably 50 parts by mass to 2,000 parts by mass, more preferably 100 parts by mass to 1,000 parts by mass. When the amount is less than 50 parts by mass, the toner materials may be insufficiently dispersed and toner particles having a predetermined particle diameter may not be obtained, and when the amount is more than 2,000 parts by mass, production costs will be increased.

If necessary, a dispersing agent can be used. The dispersing agent is preferably used because sharp particle size distribution and stable dispersion can be obtained.

The dispersion method is not particularly limited and may be appropriately selected depending on the intended purpose. For example, known methods such as low-speed shearing methods, high-speed shearing methods, friction methods, high-pressure jet methods, or ultrasonic methods can be used. Among these methods, high-speed shearing methods are preferably used because particles having a particle diameter of from 2 μm to 20 μm can be easily prepared.

When a high-speed shearing type-dispersing device is used, the rotation speed is not particularly limited and may be appropriately selected depending on the intended purpose, but is preferably 1,000 rpm to 30,000 rpm, more preferably 5,000 rpm to 20,000 rpm. The dispersion time is not particularly limited and may be appropriately selected depending on the intended purpose, but is preferably 0.1 min to 5 min in a batch manner. The temperature in the dispersion process is not particularly limited and may be appropriately selected depending on the intended purpose, but is preferably 0° C. to 150° C., preferably from 40° C. to 98° C. The temperature is preferably high, because the urea-modified polyester (i) and prepolymer (A) can easily be dispersed and the dispersion formed thereof has a low viscosity.

The urea-modified polyester (i) may be synthesized from the prepolymer (A) by adding the amines (B) in the aqueous medium before the toner materials are dispersed therein or after the toner materials are dispersed therein so as to initiate a reaction at the interface of particles. In the latter method, the urea-modified polyester is preferentially formed on the surface of the resultant toner, which generates a gradient of concentration thereof inside particles.

In the above reaction, the dispersing agent is preferably used, if necessary.

The dispersing agent is not particularly limited and may be appropriately selected depending on the intended purpose. Examples of the dispersing agent include a surfactant, an inorganic compound dispersing agents with poor water-solubility and a polymeric protective colloid. These can be used alone or in combination. Among them, the surfactant is preferable.

Examples of the surfactant include an anionic surfactant, a cationic surfactant, a nonionic surfactant and an ampholytic surfactant.

Examples of the anionic surfactant include alkylbenzene sulfonates, α-olefin sulfonates and phosphoric acid esters. Among them, those having fluoroalkyl groups are preferable. Examples of the anionic surfactant having fluoroalkyl groups include fluoroalkyl carboxylic acids having from 2 to 10 carbon atoms or metal salts thereof, disodium perfluorooctanesulfonylglutamate, sodium 3-[omega-fluoroalkyl(C6-C11)oxy]-1-alkyl(C3-C4)sulfonate, sodium 3-[omega-fluoroalkanoyl(C6-C8)-N-ethylamino]-1-propane sulfonate, fluoroalkyl(C11-C20)carboxylic acids or metal salts thereof, perfluoroalkylcarboxylic acids (C7-C13) or metal salts thereof, perfluoroalkyl(C4-C12) sulfonic acids or metal salts thereof, perfluorooctanesulfonic acid diethanol amides, N-propyl-N-(2-hydroxyethyl)perfluorooctanesulfone amide, perfluoroalkyl(C6-C10) sulfoneamidepropyl trimethyl ammonium salts, perfluoroalkyl(C6-C10)-N-ethylsulfonyl glycine salts, and monoperfluoroalkyl(C6-C16) ethylphosphate. Examples of commercial products of the surfactant having fluoroalkyl groups include SARFRON 5-111, S-112, and S-113 (all products are of ASAHI GLASS CO., LTD); FLUORAD FC-93, FC-95, FC-98, and FC-129 (all products are of Sumitomo 3M Limited); UNIDYNE DS-101, and DS-102 (all products are of DAIKIN INDUSTRIES, LTD); MEGAFACK F-110, F-120, F-113, F-191, F-812, and F-833 (all products are of DAINIPPON INK AND CHEMICALS, INCORPORATED); ECTOP EF-102, 103, 104, 105, 112, 123A, 123B, 306A, 501, 201, and 204 (all products are of Mitsubishi Materials Corporation); and FTERGENT F-100, and F-150 (all products are of NEOS Company Limited).

Examples of the cationic surfactants include amine salt surfactants and quarternary ammonium salt type cationic surfactants. Examples of the amine salt surfactants include alkylamine salts, amino alcohol fatty acid derivatives, polyamine fatty acid derivatives and imidazoline. Examples of the quarternary ammonium salt type cationic surfactants include alkyltrimethylammonium salts, dialkyldimethylammonium salts, alkyldimethylbenzylammonium salts, pyridinium salts, alkylisoquinoline salts, and benzethonium chloride. Among them, aliphatic primary, secondary or tertiary amine acids having fluoroalkyl groups, aliphatic quaternary ammonium salts such as perfluoroalkyl(C6-C10) sulfonamide propyl trimethyl ammonium salt, benzalkonium salts, benzethonium chloride, pyridinium salts and imidazolinium salts. Examples of commercial products of the cation surfactants include SARFRON S-121 (product of ASAHI GLASS CO., LTD.); FLUORAD FC-135 (product of Sumitomo 3M Limited); UNIDYNE DS-202 (product of DAIKIN INDUSTRIES, LTD), MEGAFACK F-150, F-824 (all products are of DAINIPPON INK AND CHEMICALS, INCORPORATED); ECTOP EF-132 (product of Mitsubishi Materials Corporation); and FTERGENT F-300 (product of NEOS Company Limited).

Examples of the nonionic surfactants include fatty acid amide derivatives, and polyhydric alcohol derivatives.

Examples of the ampholytic surfactants include alanine, dodecyldi(aminoethyl)glycine, di(octylaminoethyl)glycine and N-alkyl-N,N-dimethylammonium betaine.

Examples of the inorganic compound dispersing agents with poor water-solubility include calcium phosphate tribasic, calcium carbonate, titanium oxide, colloidal silica and hydroxyapatite.

Examples of the polymeric protective colloids include acids, (meth)acrylic monomers having a hydroxyl group, vinyl alcohol and ethers thereof, esters of vinyl alcohol with a compound having a carboxyl group, amide compounds or methylol compounds thereof, chlorides, homopolymers and copolymers having a nitrogen atom or a heterocyclic ring having a nitrogen atom, polyoxyethylenes and celluloses. Examples of the acids include acrylic acid, methacrylic acid, α-cyanoacrylic acid, α-cyanomethacrylic acid, itaconic acid, crotonic acid, fumaric acid, maleic acid and maleic anhydride. Examples of the (meth)acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerol monoacrylic acid ester, glycerol monomethacrylic acid ester, N-methylolacrylamide and N-methylolmethacrylamide. Examples of the vinyl alcohol and ethers thereof include vinyl methyl ether, vinyl ethyl ether and vinyl propyl ether. Examples of the esters of vinyl alcohol with a compound having a carboxyl group include vinyl acetate, vinyl propionate and vinyl butyrate. Examples of the amide compounds or methylol compounds thereof include acrylamide, methacrylamide and diacetone acrylamide or methylol compounds thereof. Examples of the chlorides include acrylate chloride and chloride methacrylate. Examples of the homopolymers and copolymers having a nitrogen atom or a heterocyclic ring having a nitrogen atom include vinyl viridine, vinylpyrrolidone, vinyl imidazole and ethyleneimine. Examples of the polyoxyethylenes are polyoxyethylene, polyoxypropylene, polyoxyethylene alkylamine, polyoxypropylene alkylamine, polyoxyethylene alkylamide, polyoxypropylene alkylamide, polyoxyethylenenonylphenylether, polyoxyethylenelaurylphenylether, polyoxyethylenestearylphenylester and polyoxyethylenenonylphenylester. Examples of the celluloses include methylcellulose, hydroxyethyl cellulose and hydroxypropylcellulose.

A dispersion stabilizer can be used for preparing the dispersion liquid, if necessary. Examples of the dispersion stabilizer include acids such as calcium phosphate and those being alkali-soluble.

When the dispersion stabilizer is used, calcium phosphate can be removed from particles after calcium phosphate is dissolved with acids such as a hydrochloric acid by washing with water or decomposing with enzymes.

In the preparation of the dispersion liquid, catalysts for the elongation reaction or the cross-linking reaction can be used. Examples of the catalysts include dibutyltin laurate, and dioctyltin laurate.

Further, in order to decrease viscosity of the toner materials, a solvent which can dissolve the urea-modified polyester (i) and the prepolymer (A) can be used, which is preferable because the resultant particles have a sharp particle size distribution. The solvent is preferably volatile from the viewpoint of being easily removed.

The solvent is not particularly limited and may be appropriately selected depending on the intended purpose. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. They can be used alone or in combination. Among them, aromatic solvents such as toluene and xylene; and halogenated hydrocarbons such as methylene chloride, 1,2-dichloroethane, chloroform and carbon tetrachloride are preferable. Aromatic solvents such as toluene and xylene are more preferable.

An amount of solvent relative to the 100 parts by mass of the prepolymer (A) is not particularly limited and may be appropriately selected depending on the intended purpose, but is preferably 300 parts by mass or less, more preferably 100 parts by mass or less, further preferably 25 parts by mass to 70 parts by mass. When solvent is used, it is removed through heating under a normal pressure or a reduced pressure after the elongation and/or cross-linking reaction.

The reaction time of the elongation and/or cross-linking reactions depends on reactivity of the isocyanate structure of the prepolymer (A) and the amines (B), but is preferably 10 min to 40 hours, more preferably 2 hours to 24 hours. The reaction temperature is not particularly limited and may be appropriately selected depending on the intended purpose, but is preferably 0° C. to 150° C., more preferably 40° C. to 98° C. Furthermore, known catalysts can be used, if necessary. Examples the catalysts include dibutyltin laurate and dioctyltin laurate.

In order to remove an organic solvent from the emulsified dispersion, it is possible to employ a method of gradually raising the temperature of the whole dispersion to completely remove the organic solvent in droplets by vaporizing. Alternatively, a method of spraying the emulsified dispersion in dry air, completely removing a water-insoluble organic solvent in droplets to form toner particles and removing an aqueous dispersing agent by vaporizing can also be used. Examples of the dry air to which the emulsified dispersion is sprayed include heated gases of atmospheric air, nitrogen gas, carbon dioxide gas, and a combustion gas. In particular, various streams, which have been heated to a temperature equal to or higher than the highest boiling point of the solvents used, are typically used. A spray dryer, a belt dryer and a rotary kiln can sufficiently remove the organic solvent in a short time.

When the emulsified dispersion is washed and dried while maintaining a wide particle size distribution thereof, the dispersion can be classified to have a desired particle size distribution.

Classification using such as a cyclone, a decanter, or a centrifugal separation can remove fine particles from a dispersion liquid. The powder remaining after drying the dispersion liquid can be classified, but the classification is preferably performed in liquid in terms of efficiency. Unnecessary fine and coarse particles can be recycled to a kneading process to form particles. The fine and coarse particles may be wet when recycled.

The dispersing agent is preferably removed from the dispersion liquid as much as possible, and more preferably removed at the same time when the above-mentioned classification is performed.

Heterogeneous particles such as releasing agent particles, charge-controlling particles, fluidizing particles and colorant particles can be mixed with the post-dried toner powder. Release of the heterogeneous particles from composite particles can be prevented by applying a mechanical impact force to a mixed powder to thereby fix and fuse them on a surface of the composite particles.

Specific methods include (1) a method of applying an impact force on the mixture with a blade rotating at high-speed and (2) a method of putting a mixture in a high-speed stream and accelerating the mixture such that particles therein collide with each other or composite particles therein collide with an adequate collision board. Examples of the device used for the methods include an ONG MILL (product of Hosokawa Micron Corp.), a modified I-type mill having a lower pulverizing air pressure (product of Nippon Pneumatic Mfg. Co., Ltd.), a hybridization system (product of Nara Machinery Co., Ltd.), a Kryptron System (product of Kawasaki Heavy Industries, Ltd.), and an automatic mortar.

—Colorant—

The colorant is not particularly limited and may be appropriately selected depending on the intended purpose. Pigments and dyes conventionally used as colorants for toners can be used. Examples thereof include carbon black, lamp black, iron black, ultramarine blue, nigrosine dyes, aniline blue, phthalocyanine blue, phthalocyanine green, hansa yellow G, rhodamine 6C lake, calco oil blue, chrome yellow, quinacridon red, benzidine yellow and rose bengal. These may be used alone or in combination.

Further, if necessary, in order to impart magnetism to toner particles, magnetic components such as iron oxides such as ferrite, magnetite and maghemite; metals such as iron, cobalt and nickel; or alloys thereof with other metals may be included in toner particles alone or in combination. In addition, these components can be used as colorant component.

The number average particle diameter of the colorants in the toner is not particularly limited and may be appropriately selected depending on the intended purpose, but is preferably 0.5 μm or less, more preferably 0.4 μm or less, further preferably 0.3 μm or less. When the number average particle diameter is more than 0.5 pigments do not have a sufficient dispersibility and the resultant toner may not have desired transparency. The colorant having the number average particle diameter smaller than 0.1 μm is sufficiently smaller than the half-wave length of visible light and considered not to have an adverse effect on light reflection and absorption of the resultant toner. The colorant having the number average particle diameter smaller than 0.1 μm contributes to good color reproducibility and transparency of an OHP sheet on which an image is fixed. To the contrary, a large number of the colorants having the particle diameter greater than 0.5 μm tend to degrade brightness and chromaticness of a projected image on an OHP sheet, because incident light is prevented from transmitting or scattered. Further, a large number of the colorants having the particle diameter greater than 0.5 μm are exfoliated from a surface of the toner particle, and tend to cause various problems such as fogging, drum contamination and cleaning defects. The colorant having the number average particle diameter greater than 0.7 μm is contained in a percentage of preferably 10% by number or less, more preferably 5% by number or less, relative to the total number of all colorants.

In the case where the colorant is previously kneaded with a part or all of binder resins in the presence of a wetter, the colorant and the binder resins sufficiently adhere to each other in advance and the colorant is more effectively dispersed into the toner particles in the subsequent steps of toner production. Therefore, the dispersed colorants have a smaller particle diameter, leading to better transparency.

The binder resin to be previously kneaded is not particularly limited, and resins exemplified with respect to the binder resins for toners can be used.

Specific examples of the method of previously kneading a mixture of the binder resin and the colorant with the wetter include a method of mixing the binder resin, the colorant and the wetter by a blender such as HENSCHEL MIXER; and kneading the mixture by a kneader such as two-roll and three-roll mills at a temperature lower than the melting point of the binder resin to thereby obtain a sample.

The wetter can be selected from among typical ones in consideration of solubility with the binder resin and wettability of the colorant. In particular, organic solvents such as acetone, toluene, and butanone or water are preferably used in terms of dispersibility of the colorant. Water is most preferably used in terms of environmental protection and the dispersion stability of the colorant in the subsequent steps of toner production.

This method not only makes the colorant particles have a small particle diameter but also increase uniformity of the dispersion status thereof, which further improves color reproducibility of images projected by OHP.

—Releasing Agent—

The toner should preferably contain a releasing agent.

The releasing agent not particularly limited and may be appropriately selected depending on the intended purpose. Examples of the releasing agents include polyolefin waxes (e.g., polyethylene wax, and polypropylene wax); long-chain hydrocarbons (e.g., paraffin waxes, and Sasol waxes); carbonyl group-containing waxes. Among them, carbonyl group-containing waxes are particularly preferable.

Examples of the carbonyl group-containing waxes include polyalkanoic acid esters (e.g., Carnauba wax, montan wax, trimethylolpropane tribehenate, pentaerythritol tetrabehenate, pentaerythritol diacetate dibehenate, glycerine tribehenate, and 1,18-octadecanediol distearate); polyalkanol esters (e.g., tristearyl trimellitate, and distearylmaleate); polyalkanoic acid amides (e.g., ethylene diamine dibehenylamide); polyalkylamide (e.g., tristearylamide trimellitate); and dialkylketones (e.g., distearylketone). Among them, polyalkanoic acid esters are particularly preferable.

The melting point of the releasing agent is not particularly limited and may be appropriately selected depending on the intended purpose, but is preferably 40° C. to 160° C., more preferably 50° C. to 120° C., further preferably 60° C. to 90° C. When the melting point is less than 40° C., heat resistant storage stability may be degraded, and when the melting point is more than 160° C., cold offset may occur during fixing at a low temperature.

The melt viscosity of the releasing agent is preferably 5 cps to 1,000 cps, more preferably 10 cps to 100 cps at the temperature 20° C. higher than the melting point. When the melt viscosity is more than 1,000 cps, hot offset resistance and low temperature fixability may be difficult to be improved.

An amount of the releasing agent contained in the toner is not particularly limited and may be appropriately selected depending on the intended purpose, but is preferably 40% by mass or less, more preferably 3% by mass to 30% by mass.

—Charge Controlling Agent—

The toner may include a charge controlling agent to obtain sufficient charge amount and achieve fast start-up time of charging toner. Almost colorless or white materials are preferably used because colored materials cause a color change of the resultant toner.

The charge controlling agent is not particularly limited and may be appropriately selected from those known in the art depending on the intended purpose. Examples of the charge controlling agent include triphenylmethane dyes, chelate compounds of molybdic acid, Rhodamine dyes, alkoxy amines, quaternary ammonium salts (including fluorine-modified quaternary ammonium salts), alkylamides, phosphor or compounds including phosphor, tungsten or compounds including tungsten, fluorine-containing activators, and metal salts of salicylic acid or salicylic acid derivatives.

The charge controlling agent may be commercial products. Examples thereof include BONTRON P-51 (quaternary ammonium salt), E-82 (metal complex of oxynaphthoic acid), E-84 (metal complex of salicylic acid), and E-89 (phenolic condensation product) (all products are of Orient Chemical Industries, Ltd.); TP-302 and TP-415 (molybdenum complex of quaternary ammonium salt) (all products are of Hodogaya Chemical Co.); COPY CHARGE PSY VP2038 (quaternary ammonium salt), COPY BLUE (triphenyl methane derivative), COPY CHARGE NEG VP2036 and NX VP434 (quaternary ammonium salt), (all products are of Hochst Corporation); LRA-901, and LR-147 (boron complex) (all products are of Japan Carlit Co., Ltd.); quinacridone, azo pigments and polymers having a functional group such as a sulfonate group, a carboxyl group, or a quaternary ammonium group. These may be used alone or in combination.

An amount of the charge controlling agent is not particularly limited and may be appropriately selected depending on the intended purpose, but is preferably 0.1 parts by mass to 10 parts by mass, more preferably 0.2 parts by mass to 5 parts by mass relative to 100 parts by mass of the toner. When the amount of the charge controlling agent is more than 10 parts by mass, the toner has excessively high chargeability, which reduces effects of the charge controlling agent, and increases the electrostatic force of a developing roller attracting the toner to thereby deteriorate the flowability of the developer and decrease of the image density. The charge controlling agent can be dissolved and dispersed after melt-kneaded together with a master batch and a binder resin, or can be directly dissolved in an organic solvent and added at the time when dispersing, or can be fixed on a toner surface after the toner particles are produced.

—Resin Particles—

During toner production process, resin particles may be added in an aqueous medium when the toner materials are dispersed therein, mainly for stabilizing the dispersibility.

The resin particles are not particularly limited and may be any resin as long as it can form an aqueous dispersion. The resin particles may be thermoplastic resins or thermosetting resins. Examples thereof include vinyl resins, polyurethane resins, epoxy resins, polyester resins, polyamide resins, polyimide resins, silicon resins, phenolic resins, melamine resins, urea resins, aniline resins, ionomer resins and polycarbonate resins. These can be used alone or in combination. Among them, vinyl resins, polyurethane resins, epoxy resins, polyester resins or combinations thereof is preferable from the viewpoint of easily obtaining an aqueous dispersion of fine spherical resin particles.

Examples of the vinyl resins include homopolymers or copolymers formed of vinyl monomers such as styrene-(meth)acrylic acid ester resin, styrene-butadiene copolymers, (meth)acrylic acid-acrylic acid ester copolymer, styrene-acrylonitrile copolymers, styrene-maleic anhydride copolymer, and styrene-(meth)acrylic acid copolymer.

—External Additive—

An external additive is added for improving flowability, developability and chargeability of toner particles. Inorganic particles are preferably used.

Examples of the inorganic particles include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulphate, barium carbonate, calcium carbonate, silicon carbide and silicon nitride. These may be used alone or in combination.

The primary particle diameter of the inorganic particles is not particularly limited and may be appropriately selected depending on the intended purpose, but is preferably 5 nm to 2 μm, more preferably 5 nm to 500 nm. A specific surface area of the inorganic particles as measured by a BET method is not particularly limited and may be appropriately selected depending on the intended purpose, but is preferably 20 $m^2/g$ to 500 $m^2/g$. An amount of the inorganic particles added to the toner is not particularly limited and may be appropriately selected depending on the intended purpose, but is preferably 0.01% by mass to 5% by mass, more preferably 0.01% by mass to 2.0% by mass.

Examples of other external additive include polymer particles such as polystyrene formed through soap-free emulsion polymerization, suspension polymerization, or dispersion polymerization; polycondensation products such as methacrylic acid ester copolymer, acrylic acid ester copolymer, silicone, benzoguanamine, and nylon; and polymer particles of thermosetting resins.

A fluidizer can be contained in the toner. The fluidizer can prevent degradation of flowability and chargeability even under a high humidity condition by increasing hydrophobicity through a surface treatment. Examples of the fluidizer include silane coupling agents, silylation agents, silane-coupling agents having an alkyl fluoride group, organotitanium coupling agents, aluminum coupling agents, silicone oil, and modified silicone oil.

The toner may include a cleanability improver for removing an untransferred developer remaining on a photoconductor and an intermediate transfer medium. Examples thereof include metallic soaps such as zinc stearate, calcium stearate and stearic acid; and polymer particles produced through soap-free emulsion polymerization such as polymethylmethacrylate particles and polystyrene particles. The polymer particles preferably have a relatively narrow particle size distribution and volume average particle diameter of 0.01 μm to 1 μm.

With use of the toner, high-quality toner images can be formed with excellent in developing stability.

The image forming apparatus of the present invention can use an unstructured toner produced through pulverization as well as a toner which is produced through polymerization as described above and is suitable for obtaining high-quality images. Also in the former case, apparatus life can be drastically extended. Conventional toner materials used for electrophotographic toners can be used for the toner produced through pulverization without any limitation.

The binder resin used for the toner produced through pulverization is not particularly limited and may be appropriately selected depending on the intended purpose. Examples thereof include styrene or substituted styrene homopolymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, and styrene-maleic acid copolymers; acrylic ester homopolymers or copolymers such as polymethyl acrylate, polybutyl acrylate, polymethyl methacrylate and polybutyl methacrylate; polyvinyl derivatives such as polyvinylchloride and polyvinyl acetate; polyester polymers; polyurethane polymers; polyamide polymers; polyimide polymers; polyol polymers; epoxy polymers; terpene polymers; aliphatic or alicyclic hydrocarbon resins; and aromatic petroleum resins. These may be used alone or in combination. Among them, styrene-acrylic copolymer resins, polyester resins and polyol resins are preferable from the viewpoints of good electricity and costs. Further, polyester resins and polyol resins are particularly preferable from the viewpoint of good fixability.

The toner produced through pulverization can be produced as follows. The colorant, the releasing agent, and the charge controlling agent are optionally premixed together with the binder resin, and kneaded at near a melting temperature of the binder resin, following by cooling, pulverizing, and classifying. In addition, the external additive may be appropriately added, if necessary.

The developing device can be either a dry-developing type or a wet-developing type, and a monochrome developing device or a multicolor developing device. Suitable examples thereof include those including a stirrer configured to charge the toner or the developer through friction-stirring and a rotatable magnetic roller.

In the developing device, toner particles and carrier particles are stirred so that the toner particles are charged by friction generated therebetween. The charged toner particles are retained in the chain-like form on the surface of the rotating magnetic roller to form a magnetic brush. The magnetic roller is disposed proximately to the image bearing member and thus, some of the toner particles forming the magnetic brush formed on the magnetic roller surface are electrically adsorbed onto the image bearing member surface. As a result, a latent electrostatic image is developed with the toner particles to form a visible toner image on the image bearing member surface.

A developer contained in the developing device is a developer containing the toner, and may be a one-component developer or a two-component developer.

<Transfer Step and Transfer Unit>

The transfer step is a step of transferring the visible image onto a recording medium. Preferably, the visible image is primarily transferred onto the intermediate transfer member and then the visible image is secondarily transferred onto the recording medium. More preferably, two or more color toners, preferably full-color toners are used, the transfer step includes a primary transfer step of transferring the visible image onto the intermediate transfer member to form a composite transfer image thereon, and a secondary transfer step of transferring the composite transfer image onto a recording medium.

The transferring can be performed, for example, by charging the visible image formed on the image bearing member using a transfer-charger, and can be performed by the transfer unit. The transfer step preferably includes a primary transfer step of transferring the visible image onto the intermediate transfer member to form a composite transfer image thereon, and a secondary transfer step of transferring the composite transfer image onto a recording medium.

The intermediate transfer member is not particularly limited and may be appropriately selected from those known in the art depending on the intended purpose. Example thereof includes a transfer belt.

The image bearing member may be an intermediate transfer member used for image forming with a so-called intermediate transfer method in which a toner image formed on a photoconductor is primarily transferred to superpose color toners on top of another on the intermediate transfer medium and then transferred onto the recording medium.

—Intermediate Transfer Member—

The intermediate transfer member preferably has volume resistivity of $1.0\times10^{5}$ Ω·cm to $1.0\times10^{11}$ Ω·cm. When the volume resistivity is less than $1.0\times10^{5}$ Ω·cm, so-called transfer dust is likely to be caused, i.e., the resulting toner images become unstable due to discharge generated when the toner images are transferred onto the intermediate transfer medium from the photoconductor. When the volume resistivity is more than $1.0\times10^{11}$ Ω·cm, a charge counter to that held on the toner images remain on the intermediate transfer member after the toner image are transferred onto a transfer medium therefrom, which may cause image lag (a residual image) on a subsequently processed image.

As the intermediate transfer medium, for example, a belt-shaped or cylindrical plastic product which is produced by the following manner can be used. Specifically, metal oxides (e.g., tin oxide or indium oxide), electroconductive particles (e.g., carbon black) and/or electroconductive polymers are used alone or in combination and kneaded with a thermoplastic resin, and the kneaded product is subjected to extrusion-molding. Besides the above method, an intermediate transfer member in the form of an endless belt can also be produced in the following manner. Specifically, the above-mentioned electroconductive particles and/or electroconductive polymers are added, if necessary, to a resin-based liquid containing heat-cross-linkable monomers or oligomers, followed by being centrifugally molded under application of heat.

When a surface layer is formed on the intermediate transfer medium, an electroconductive material can be appropriately used in combination with a composition of materials for forming a surface layer, which are used in the photoconductor surface layer, but excluding charging transporting materials so as to control the resistivity.

The transfer unit (the primary transfer unit and the secondary transfer unit) preferably has at least a transfer device configured to transfer the visible images which has been formed on the image bearing member onto the recording medium through peeling charge. There may be one transfer unit or two or more transfer units. Examples of the transfer device include a corona transfer device using corona discharge, a transfer belt, a transfer roller, a press transfer roller and an adhesion transfer device.

Notably, the recording medium is not particularly limited and may be appropriately selected from known recording media (recording paper) depending on the intended purpose.

<Protective Layer Forming Step and Protective Layer Forming Unit>

The protective layer forming step is a step of forming a protective layer on the surface of the post-transferred image bearing member by applying the image bearing member protecting agent of the present invention.

The above described protective layer forming unit of the present invention can be used as the protective layer forming unit.

<Other Steps and Other Units>

—Fixing Step and Fixing Unit—

The fixing step is a step of fixing a visible image which has been transferred on the recording medium by means of the fixing unit. The fixing step may be performed every time when an image of each color toner is transferred onto the recording medium, or at one time (at the same time) on a laminated image of color toners.

The fixing unit is not particularly limited and may be appropriately selected depending on the intended purpose, but is preferably known heating-pressurizing units. Examples thereof include a combination of a heat roller and a pressure roller, and a combination of a heat roller, a pressure roller and an endless belt.

The heating temperature of the heating-pressurizing unit is not particularly limited and may be appropriately selected depending on the intended purpose, but is preferably 80° C. to 200° C.

Notably, in the present invention, known photofixing devices may be used instead of or in addition to the fixing step and the fixing unit depending on the intended purpose.

—Cleaning Step and Cleaning Unit—

The cleaning step is a step of removing the toner remaining on the image bearing member. It may be suitably performed by the cleaning unit.

The cleaning unit is preferably provided on a downstream side of the transfer unit and an upstream side of the protective layer forming unit.

The cleaning unit is not particularly limited and may be appropriately selected depending on the intended purpose, as long as it can remove the toner remaining on the image bearing member. Examples thereof include a magnetic brush cleaner, an electrostatic brush cleaner, a magnetic roller cleaner, a blade cleaner, a brush cleaner and a web cleaner.

—Charge-Eliminating Step and Charge-Eliminating Unit—

The charge-eliminating step is a step of applying a charge-eliminating bias to the image bearing member to thereby charge-eliminate. It may be suitably performed by the charge-eliminating unit.

The charge-eliminating unit is not particularly limited and may be appropriately selected depending from known charge eliminators, as long as it can apply a charge-eliminating bias to the image bearing member. Example thereof includes a charge-eliminating lamp.

—Recycling Step and Recycling Unit—

The recycling step is a step of recycling the toner which has been removed at the cleaning step to the developing device. The recycling step can be suitable performed by the recycling unit.

The recycling unit is not particularly limited and may be appropriately selected depending on the intended purpose. Examples thereof include known conveying units.

—Control Step and Control Unit—

The control step is a step of controlling the operation of each of the above units. The control step can be suitably performed by the control unit.

The control unit is not particularly limited and may be appropriately selected depending on the intended purpose, as long as it can control the operation of each of the above units. Examples thereof include devices such as sequencer and computer.

Figure 2:
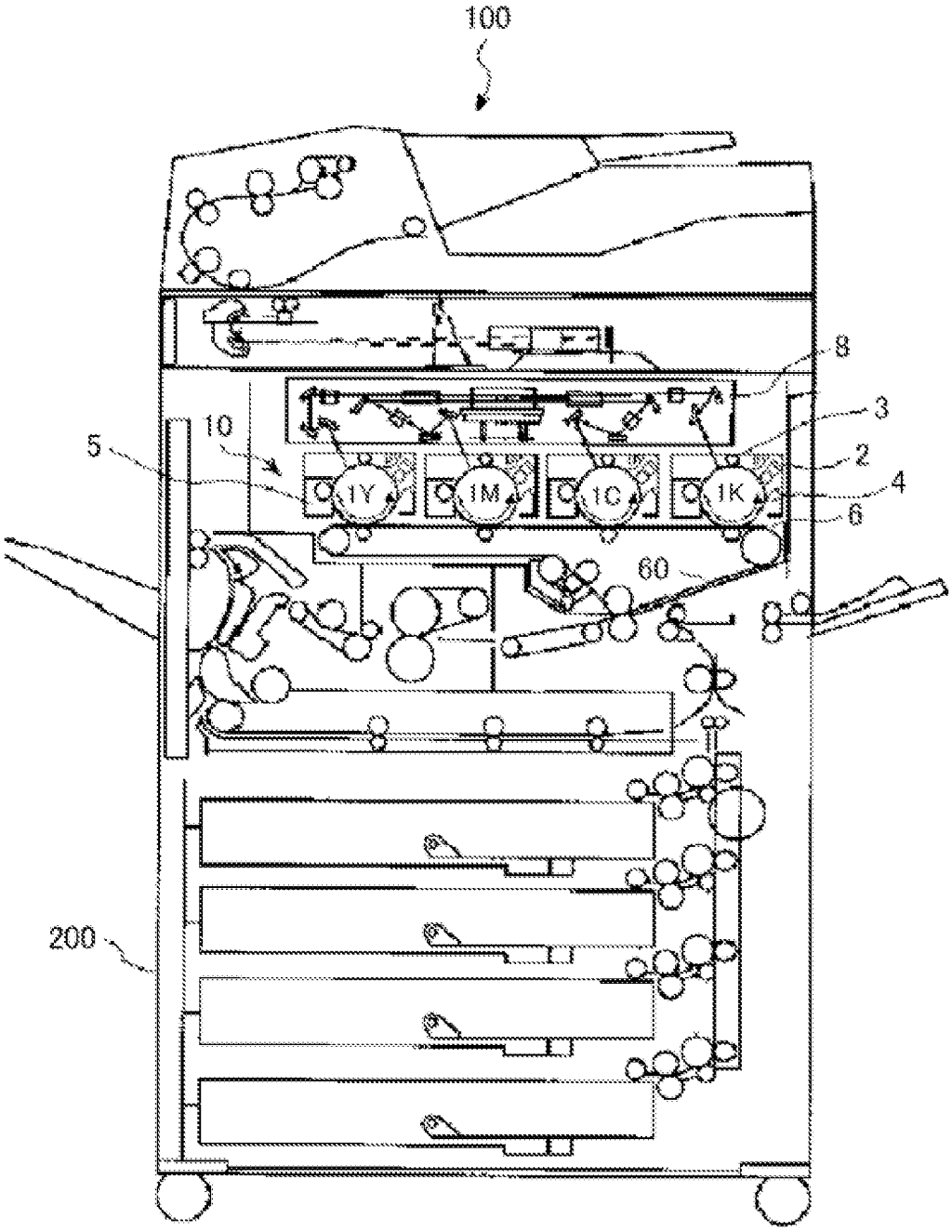
FIG. 2 is a schematic diagram showing one exemplary image forming apparatus of the present invention.

FIG. 2 is a cross sectional diagram showing one exemplary image forming apparatus 100 including the protective layer forming device of the present invention.

A protective layer forming device 2, a charging unit 3, an exposing unit 8, a developing unit 5, a transfer unit 6 and a cleaning unit 4 are arranged around each of drum-shaped image bearing members 1Y, 1M, 1C and 1K, and image forming is performed as follows.

Hereinafter, an image forming process using negative/positive process will be described. The image bearing member 1 may be an OPC (organic photoconductor) having an organic photoconductive layer, which is charge-eliminated by a charge-eliminating lamp (not illustrated) and uniformly negatively charged by the charging unit 3.

When the image bearing member is charged by the charging unit 3, an appropriate voltage or a charging voltage in which alternating-voltage is superimposed on the voltage, which is suitable for charging the image bearing members 1Y, 1M, 1C, and 1K to a desired potential, is applied from a voltage applying mechanism (not illustrated) to the charging unit.

The charged image bearing members 1Y, 1M, 1C, and 1K are then irradiated with a laser beam emitted from the exposing unit 8 (e.g., laser optical system) to thereby form a latent image, in which an absolute potential value of light-exposed portion becomes smaller than an absolute potential value of non-exposed portion.

The laser beam, emitted by a semiconductor laser, is reflected by a polygon mirror rotating at a high speed, and then scanned on the surface of the image bearing members 1Y, 1M, 1C, and 1K in a rotating axial direction of the image bearing members.

Such formed latent image is then developed with a toner or a developer containing a toner and a carrier which has been supplied onto a developing sleeve serving as a developer bearing member in the developing unit 5 to thereby form a toner image.

When developing the latent electrostatic image, a voltage applying mechanism (not illustrated) applies an appropriate voltage or a developing bias in which alternating-voltage is superimposed on the voltage to the developing sleeve which is provided between a light-exposed portion and a non-exposed portion of each of the image bearing members 1Y, 1M, 1C, and 1K.

The toner images formed on the image bearing members 1Y, 1M, 1C, and 1K are transferred onto the intermediate transfer member 60 by the transfer unit 6, and then transferred onto a recording medium such as a paper fed from a paper feeding unit 200.

In such transfer process, a transfer bias voltage, i.e., a potential having a polarity opposite to a polarity of toner particles is preferably applied to the transfer unit 6. Then, the intermediate transfer member 60 is separated from the image bearing member 1 to thereby obtain a transfer image.

Toner remaining on the image bearing member is removed by the cleaning unit 4, and then recycled to a toner recycling section in the cleaning unit 4.

The image forming apparatus may be apparatus in which a plurality of developing devices are used, and a plurality of different-color toner images produced by the plurality of developing devices are sequentially transferred to a recording medium, followed by conveying to a fixing unit, where the toner images are fixed with heat. Alternatively, the image forming apparatus may apparatus in which a plurality of toner images, which are formed similarly to the same manner, are sequentially transferred to an intermediate transfer member once and then further transferred to a transfer medium (e.g. paper) at a time, and then the toner images are fixed.

The charging unit 3 is preferably in contact with the image bearing member or disposed in proximity to the image bearing member. A discharging wire is used as the charging unit. With this configuration, an amount of ozone generated during a charging process can be greatly decreased, compared to a corona discharger, such as corotron or scorotron.

However, in such charging unit which is in contact with the image bearing member or disposed in proximity to the image bearing member, because electrical discharge occurs in proximity to the image bearing member surface, a greater electrical stress is applied to the image bearing member. With use of the protective layer forming device using the image bearing member protecting agent of the present invention, the image bearing member can be stably maintained without substantially causing deterioration of the image bearing member over a long period of time. Thus, image quality can be stably maintained.

<Process Cartridge>

The process cartridge of the present invention includes at least an image bearing member and the protective layer forming unit of the present invention; and, if necessary, further includes other units such as a charging unit, an exposing unit, a developing unit, a transfer unit, a cleaning unit and a charge-elimination unit.

The process cartridge of the present invention can be detachably attached to various electrophotographic image forming apparatuses, and is preferably detachably attached to the image forming apparatus of the present invention.

Figure 3:
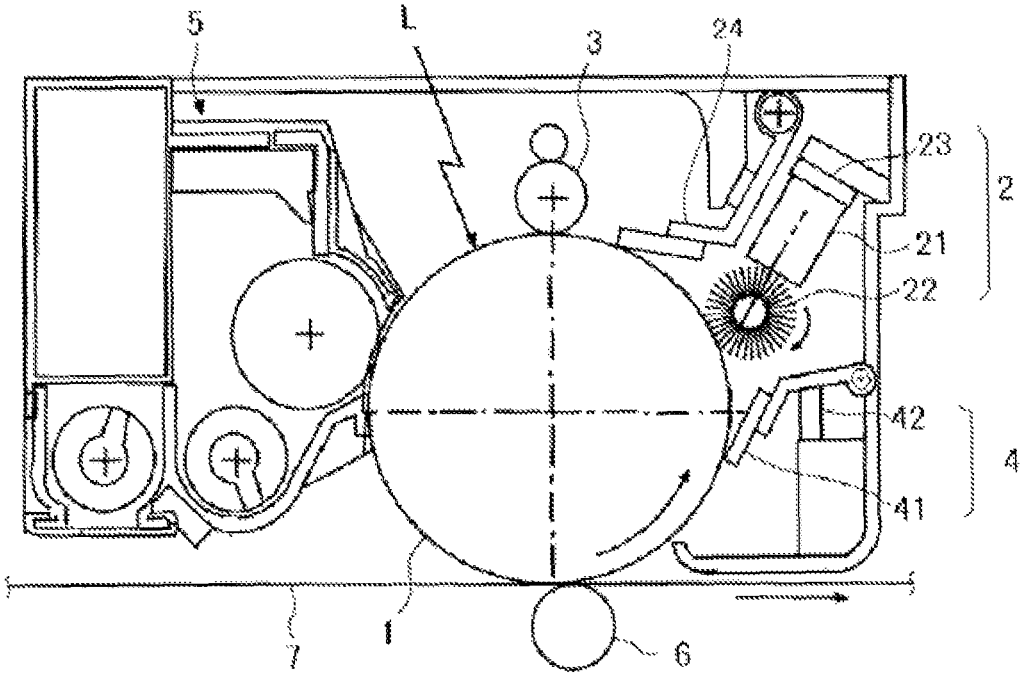
FIG. 3 is a schematic diagram showing one exemplary process cartridge used in the present invention.

FIG. 3 is a schematic diagram showing one exemplary process cartridge used in the present invention.

The process cartridge includes an image bearing member 1, a protective layer forming device 2 placed so as to face the image bearing member, an image bearing member protecting agent 21, a protecting agent supplying member 22, a pressing force applying member 23, and a protective layer forming member 24.

On the surface of the image bearing member 1, residues such as the image-bearing member protecting agent partially deteriorated and toner components remain after a transfer process. The residues are removed by a cleaning unit 4 so as to be cleaned.

In FIG. 3, the cleaning unit 4 is provided on an upstream side of an image bearing member protecting agent supplying portion; includes a cleaning member 41 and a cleaning pressing mechanism 42; and is contacted to the image bearing member at an angle like a (leading) counter type.

To the surface of the image bearing member 1 from which residues such as toner and deteriorated image bearing member protecting agent have been removed by the cleaning unit 4, the image bearing member protecting agent 21 is supplied from the protecting agent supplying member 22, and a film-like protective layer is formed by the protective layer forming member 24. The image bearing member protecting agent 21 of the present invention has better adsorptivity to a portion having higher hydrophilicity due to electrical stress on the surface of the image bearing member. Therefore, even when the surface of the image bearing member begins to partially deteriorate by the action of temporarily applied great electrical stress, the protecting agent is adsorbed onto the image bearing member to thereby prevent the deterioration from progressing.

The image bearing member 1 on which the film-like protective layer has been formed is then charged by the charging unit 3 and exposed to an exposure light L such as a laser so that a latent electrostatic image is formed on the surface. This latent image is developed and visualized by the developing unit 5, and then transferred to a recording medium 7 by a transfer unit 6 which is placed outside the process cartridge.

The process cartridge and the image forming apparatus of the present invention can prevent abrasion of an image bearing member, toner filming on the image bearing member, smear of a charging unit, and passing-through of toner at a cleaning step; and allow extremely high-quality images to be stably formed for a long period of time.

EXAMPLES

The present invention will be explained with reference to the following Examples. However, the present invention is not limited thereto.

The aspect ratios of the inorganic lubricants used in the following Examples and Comparative Examples were measured as follows.

<Measurement of Aspect Ratio of Inorganic Lubricant>

The aspect ratio of the inorganic lubricant was measured by observing the inorganic lubricant under a scanning electron microscope (SEM) (Thermal F-SEM, product of Carl Zeiss AG, ULTRA 55), followed by analyzing using an image analysis and measurement software (IMAGE-PRO PLUS 4.0j, product of Roper Industries, Inc.). An average value of major axis lengths of primary particles of the inorganic lubricant was determined as an average particle diameter x, an average value of minor axis lengths of primary particles of the inorganic lubricant was determined as an average thickness t, and a ratio of x to t (x/t) was determined as an aspect ratio. Notably, randomly selected 10 particles were used for determining the aspect ratio.

Example 1

—Production of Image Bearing Member Protecting Agent—

A mixture of 90 parts by mass of zinc stearate (product of Wako Pure Chemical Industries, Ltd.) serving as a fatty acid metal salt and 10 parts by mass of boron nitride 3 (product of Mizushima Ferroalloy Co., Ltd., HP-P1, aspect ratio: 100)

serving as an inorganic lubricant is charged into a predetermined-sized mold, followed by leveling, and compression-molding at a pressure of 130 kN for a pressurizing time of 10 seconds. After cooling, a solid was removed from the mold, cut into cuboids of 10 mm×21 mm×300 mm, and adhered to a metal support via a double-sided tape. Thus, an image bearing member protecting agent was produced.

<Image Formation>

A modified image forming apparatus illustrated in FIG. 2 (IMAGIO MP C4500, product of Ricoh Company, Ltd.) was used to apply the image bearing member protecting agent to a photoconductor serving as an image bearing member. That is, the photoconductor which is used as an image bearing member in the image forming apparatus (standard equipment of IMAGIO MP C4500) was used in an image forming portion of the image forming apparatus (IMAGIO MP C4500, product of Ricoh Company, Ltd.). The image bearing member protecting agent of Example 1 was used instead of the image bearing member protecting agent used in the image forming apparatus. Also, a brush roller which is used as a protecting agent supplying member in the image forming apparatus was used without substituting. The toner used in the image forming apparatus (standard equipment of IMAGIO MP C4500) was used.

Next, the image forming apparatus was evaluated for smear of a charging unit, protectivity of photoconductor, and cleanability as follows. Results are shown in Tables 1 to 4.

<Smear of Charging Unit>

A test chart having an image area ratio of 5% (A4 size) was used to output images onto 100,000 sheets of paper. Then, the charging unit (charging roller) was visually observed and evaluated for smear of the charging unit according to the following criteria.

[Evaluation Criteria]

A: The charging unit was hardly smeared.

B: The charging unit was slightly smeared, but did not affect an image under a normal temperature environment (23° C., 50% RH).

C: The charging unit was smeared, and abnormal images (images having black streaks) were formed under a low temperature environment (10° C., 15% RH).

D: The charging unit was significantly smeared, and abnormal images (images having black streaks) were formed from an early stage (after printing about 5,000 sheets).

<Protectivity of Photoconductor>

A test chart having an image area ratio of 5% (A4 size) was used to output images onto 100,000 sheets of paper. Then, a photoconductor was visually observed and evaluated for protectivity of photoconductor according to the following criteria.

[Evaluation Criteria]

A: The photoconductor was hardly abraded and toner filming was hardly occurred on the photoconductor.

B: Toner filming was slightly occurred on the photoconductor, which was an acceptable level.

C: Toner filming was occurred on the photoconductor, and abnormal images (images having white streaks) were formed over time (after printing about 20,000 sheets).

D: Toner filming was occurred on the photoconductor, and abnormal images (images having white streaks) were formed from an early stage (after printing about 5,000 sheets).

<Cleanability>

After printing 500 sheets of paper, the image bearing member was replaced with a new image bearing member. Subsequently, a "passed-through toner catcher" (a felt having a size of 8 mm×310 mm with a thickness of 1 mm, product of TSUCHIYA CO., LTD.) was attached to a downstream side of a cleaning blade and the top end of an opening of a developing unit via a piece of linear sponge tape (thickness: 2 mm, product of Sumitomo 3M Ltd., SCOTCH TAPE 4016). After printing (feeding) 100 sheets of paper having an image area ratio of 5%, the toner which had passed through the cleaning blade was collected by the "passed-through toner catcher" during printing (feeding) 20 sheets of paper having an image area ratio of 5%. The collected toner was converted to digital data by an image scanner and measured for concentration, followed by evaluating for cleanability according to the following criteria. Notably, the higher the concentration is, the more the toner passed through the cleaning blade.

[Evaluation Criteria]

A: The toner hardly passed through the cleaning blade.

B: The toner passed through the cleaning blade, but abnormal images (images having black streaks) were not formed.

C: The toner passed through the cleaning blade, and abnormal images (images having black streaks) were formed in some cases.

D: The toner often passed through the cleaning blade, and abnormal images (images having black streaks) were frequently formed.

Examples 2 to 12 and Comparative Examples 1 to 11

—Production and Evaluation of Image Bearing Member Protecting Agent—

The image bearing member protecting agents of Examples 2 to 12 and Comparative Examples 1 to 11 were produced in the same manner as in Example 1, except that type and amount of fatty acid metal salts and inorganic lubricants were changed to as described in Tables 1 to 4.

Thus produced image bearing member protecting agents were evaluated for smear of a charging unit, protectivity of photoconductor, and cleanability in the same manner as in Example 1. Results are shown in Tables 1 to 4.

TABLE 1

| | | Aspect Ratio x/t | Ex. 1 | Ex. 2 | Ex. 3 | Ex. 4 | Ex. 5 | Ex. 6 |
|---|---|---|---|---|---|---|---|---|
| Fatty Acid Metal Salt | Zinc Stearate | — | 90 | 90 | 90 | 90 | 90 | — |
| | Calcium Stearate | — | — | — | — | — | — | 90 |
| | Zinc Laurate | — | — | — | — | — | — | — |
| Inorganic Lubricant | Boron Nitride 1 | 36 | — | — | — | — | — | — |
| | Boron Nitride 2 | 50 | — | — | — | — | — | — |
| | Boron Nitride 3 | 100 | 10 | — | — | — | — | — |
| | Boron Nitride 4 | 119 | — | 10 | — | — | — | 10 |
| | Boron Nitride 5 | 179 | — | — | 10 | — | — | — |
| | Boron Nitride 6 | 269 | — | — | — | 10 | — | — |
| | Boron Nitride 7 | 381 | — | — | — | — | 10 | — |
| | Boron Nitride 8 | 448 | — | — | — | — | — | — |
| | Mica 1 | 170 | — | — | — | — | — | — |
| | Mica 2 | 420 | — | — | — | — | — | — |
| Evaluation | Smear of Charging Unit | | B | B | B | A | A | B |
| | Protectivity of photoconductor | | A | A | B | B | B | B |
| | Cleanability | | B | B | B | A | A | B |

TABLE 2

| | | Aspect Ratio x/t | Ex. 7 | Ex. 8 | Ex. 9 | Ex. 10 | Ex. 11 | Ex. 12 |
|---|---|---|---|---|---|---|---|---|
| Fatty Acid Metal Salt | Zinc Stearate | — | — | 95 | 98 | 85 | 85 | 90 |
| | Calcium Stearate | — | — | — | — | — | — | — |
| | Zinc Laurate | — | 90 | — | — | — | — | — |

TABLE 2-continued

| | | Aspect Ratio x/t | Ex. 7 | Ex. 8 | Ex. 9 | Ex. 10 | Ex. 11 | Ex. 12 |
|---|---|---|---|---|---|---|---|---|
| Inorganic Lubricant | Boron Nitride 1 | 36 | — | — | — | — | — | — |
| | Boron Nitride 2 | 50 | — | — | — | — | — | — |
| | Boron Nitride 3 | 100 | — | — | — | — | — | — |
| | Boron Nitride 4 | 119 | 10 | — | — | — | — | 5 |
| | Boron Nitride 5 | 179 | — | — | — | — | — | — |
| | Boron Nitride 6 | 269 | — | 5 | 2 | 15 | — | 5 |
| | Boron Nitride 7 | 381 | — | — | — | — | — | — |
| | Boron Nitride 8 | 448 | — | — | — | — | — | — |
| | Mica 1 | 170 | — | — | — | — | 15 | — |
| | Mica 2 | 420 | — | — | — | — | — | — |
| Evaluation | Smear of Charging Unit | | B | B | B | A | B | B |
| | Protectivity of photoconductor | | B | A | A | B | B | B |
| | Cleanability | | B | B | B | A | B | B |

<Inorganic Lubricant>

Boron Nitride 1: boron nitride (product of Saint-Gobain K.K., IDL 600, aspect ratio: 36)

Boron Nitride 2: boron nitride (product of ESK CERAMICS GMBH & CO. KG, S1-F, aspect ratio: 50)

Boron Nitride 3 (product of Mizushima Ferroalloy Co., Ltd., HP-P1, aspect ratio: 100)

Boron Nitride 4: boron nitride (product of FNAMI TECHNOLOGY CORP., FNAMI 050, aspect ratio: 119)

Boron Nitride 5: boron nitride (product of FNAMI TECHNOLOGY CORP., FNAMI 010, aspect ratio: 179)

Boron Nitride 6: boron nitride (product of Saint-Gobain K.K., IDL 700, aspect ratio: 269)

Boron Nitride 7: boron nitride (product of DENKI KAGAKU KOGYO KABUSHIKI KAISHA, GP, aspect ratio: 381)

Boron Nitride 8: boron nitride (product of Saint-Gobain K.K., IDL 800, aspect ratio: 448)

TABLE 3

| | | Aspect Ratio x/t | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Fatty Acid Metal Salt | Zinc Stearate | — | 100 | 90 | 90 | 90 | 90 | 80 |
| | Calcium Stearate | — | — | 10 | — | — | — | — |
| | Zinc Laurate | — | — | — | 10 | — | — | — |
| Inorganic Lubricant | Boron Nitride 1 | 36 | — | — | — | 10 | — | — |
| | Boron Nitride 2 | 50 | — | — | — | — | 10 | — |
| | Boron Nitride 3 | 100 | — | — | — | — | — | — |
| | Boron Nitride 4 | 119 | — | — | — | — | — | — |
| | Boron Nitride 5 | 179 | — | — | — | — | — | — |
| | Boron Nitride 6 | 269 | — | — | — | — | — | 20 |
| | Boron Nitride 7 | 381 | — | — | — | — | — | — |
| | Boron Nitride 8 | 448 | — | — | — | — | — | — |
| | Mica 1 | 170 | — | — | — | — | — | — |
| | Mica 2 | 420 | — | — | — | — | — | — |
| Evaluation | Smear of Charging Unit | | D | C | C | C | C | A |
| | Protectivity of photoconductor | | A | B | B | A | B | C |
| | Cleanability | | C | D | D | C | C | A |

TABLE 4

| | | Aspect Ratio x/t | Comp. Ex. 7 | Comp. Ex. 8 | Comp. Ex. 9 | Comp. Ex. 10 | Comp. Ex. 11 |
|---|---|---|---|---|---|---|---|
| Fatty Acid Metal Salt | Zinc Stearate | — | 80 | 90 | 90 | 84 | 99 |
| | Calcium Stearate | — | — | — | — | — | — |
| | Zinc Laurate | — | — | — | — | — | — |
| Inorganic Lubricant | Boron Nitride 1 | 36 | — | — | — | — | — |
| | Boron Nitride 2 | 50 | — | — | — | — | — |
| | Boron Nitride 3 | 100 | — | — | — | — | — |
| | Boron Nitride 4 | 119 | — | — | — | — | — |
| | Boron Nitride 5 | 179 | — | — | — | — | — |
| | Boron Nitride 6 | 269 | — | — | — | 16 | 1 |
| | Boron Nitride 7 | 381 | 20 | — | — | — | — |
| | Boron Nitride 8 | 448 | — | 10 | — | — | — |
| | Mica 1 | 170 | — | — | — | — | — |
| | Mica 2 | 420 | — | — | 10 | — | — |
| Evaluation | Smear of Charging Unit | | A | C | D | A | D |
| | Protectivity of photoconductor | | C | C | C | C | A |
| | Cleanability | | A | C | D | A | D |

The fatty acid metal salts and the inorganic lubricants in Tables 1 to 4 are detailed as follows.

<Fatty Acid Metal Salt>

Zinc Stearate (product of Wako Pure Chemical Industries, Ltd.)

Calcium Stearate (product of Wako Pure Chemical Industries, Ltd.)

Zinc Laurate (product of Wako Pure Chemical Industries, Ltd.)

Mica 1 (product of YAMAGUCHI MICA CO., LTD., Y-1800, aspect ratio: 170)

Mica 2 (product of YAMAGUCHI MICA CO., LTD., TM-200, aspect ratio: 420)

Embodiments of the present invention as follows:

<1> An image bearing member protecting agent including:

a fatty acid metal salt; and an inorganic lubricant, wherein an aspect ratio (average major axis length/average minor axis length) of the inorganic lubricant is 60 to 400, and wherein a mass ratio of the fatty acid metal salt to the inorganic lubricant (fatty acid metal salt/inorganic lubricant) is 98/2 to 85/15.

<2> The image bearing member protecting agent according to <1>, wherein the aspect ratio (average major axis length/average minor axis length) of the inorganic lubricant is 100 to 300.

<3> The image bearing member protecting agent according to <1> or <2>, wherein the mass ratio of the fatty acid metal salt to the inorganic lubricant (fatty acid metal salt/inorganic lubricant) is 95/5 to 90/10.

<4> The image bearing member protecting agent according to any one of <1> to <3>, wherein the inorganic lubricant is boron nitride.

<5> The image bearing member protecting agent according to any one of <1> to <3>, wherein the fatty acid metal salt is zinc stearate.

<6> A protective layer forming device including:

the image bearing member protecting agent according to any one of <1> to <5>; and an image bearing member protecting agent supplying member configured to supply the image bearing member protecting agent to a surface of an image bearing member.

<7> The protective layer forming device according to <6>, further including an protective layer forming member configured to press the image bearing member protecting agent which has been supplied to the image bearing member against the surface of the image bearing member to thereby form a protective layer on the surface of the image bearing member.

<8> An image forming apparatus including:

an image bearing member;

a latent electrostatic image forming unit configured to form a latent electrostatic image on the image bearing member;

a developing unit configured to develop the latent electrostatic image with a toner to thereby form a visible image;

a transfer unit configured to transfer the visible image onto a recording medium; and a protective layer forming unit configured to apply an image bearing member protecting agent onto a surface of the image bearing member on which the visible image has been transferred, to thereby form a protective layer, wherein the protective layer forming unit is the protective layer forming device according to <6> or <7>.

<9> The image forming apparatus according to <8>, further including, at a downstream side of the transfer unit and an upstream side of the protective layer forming unit in a rotation direction of the image bearing member, a cleaning unit configured to remove a toner remaining on the surface of the image bearing member.

This application claims priority to Japanese application No. 2012-221226, filed on Oct. 3, 2012 and incorporated herein by reference.

What is claimed is:

1. An image bearing member protecting agent comprising:

a fatty acid metal salt; and an inorganic lubricant, wherein an aspect ratio (average major axis length/average minor axis length) of the inorganic lubricant is 60 to 400, and wherein a mass ratio of the fatty acid metal salt to the inorganic lubricant (fatty acid metal salt/inorganic lubricant) is 98/2 to 85/15.

2. The image bearing member protecting agent according to claim 1, wherein the aspect ratio (average major axis length/average minor axis length) of the inorganic lubricant is 100 to 300.

3. The image bearing member protecting agent according to claim 1, wherein the mass ratio of the fatty acid metal salt to the inorganic lubricant (fatty acid metal salt/inorganic lubricant) is 95/5 to 90/10.

4. The image bearing member protecting agent according to claim 1, wherein the inorganic lubricant is boron nitride.

5. The image bearing member protecting agent according to claim 1, wherein the fatty acid metal salt is zinc stearate.

6. A protective layer forming device comprising:

an image bearing member protecting agent; and an image bearing member protecting agent supplying member configured to supply the image bearing member protecting agent to a surface of an image bearing member, wherein the image bearing member protecting agent comprises a fatty acid metal salt, and an inorganic lubricant, wherein an aspect ratio (average major axis length/average minor axis length) of the inorganic lubricant is 60 to 400, and wherein a mass ratio of the fatty acid metal salt to the inorganic lubricant (fatty acid metal salt/inorganic lubricant) is 98/2 to 85/15.

7. The protective layer forming device according to claim 6, further comprising a protective layer forming member configured to press the image bearing member protecting agent which has been supplied to the image bearing member against the surface of the image bearing member to thereby form a protective layer on the surface of the image bearing member.

8. An image forming apparatus comprising:

an image bearing member;

a latent electrostatic image forming unit configured to form a latent electrostatic image on the image bearing member;

a developing unit configured to develop the latent electrostatic image with a toner to thereby form a visible image;

a transfer unit configured to transfer the visible image onto a recording medium; and a protective layer forming unit configured to apply an image bearing member protecting agent onto a surface of the image bearing member on which the visible image has been transferred, to thereby form a protective layer, wherein the protective layer forming unit comprises the image bearing member protecting agent, and an image bearing member protecting agent supplying member configured to supply the image bearing member protecting agent to the surface of the image bearing member, wherein the image bearing member protecting agent comprises a fatty acid metal salt, and an inorganic lubricant, wherein an aspect ratio (average major axis length/average minor axis length) of the inorganic lubricant is 60 to 400, and wherein a mass ratio of the fatty acid metal salt to the inorganic lubricant (fatty acid metal salt/inorganic lubricant) is 98/2 to 85/15.

9. The image forming apparatus according to claim 8, further comprising, at a downstream side of the transfer unit and an upstream side of the protective layer forming unit in a rotation direction of the image bearing member, a cleaning unit configured to remove a toner remaining on the surface of the image bearing member.

* * * * *